US006846600B2

(12) United States Patent
Ehara et al.

(10) Patent No.: US 6,846,600 B2
(45) Date of Patent: Jan. 25, 2005

(54) ELECTROPHOTOGRAPHIC PHOTOSENSITIVE MEMBER, PROCESS FOR ITS PRODUCTION, AND ELECTROPHOTOGRAPHIC APPARATUS

(75) Inventors: Toshiyuki Ehara, Kanagawa (JP); Junichiro Hashizume, Shizuoka (JP); Masaya Kawada, Shizuoka (JP); Tetsuya Karaki, Shizuoka (JP); Hironori Ohwaki, Shizuoka (JP); Kunimasa Kawamura, Shizuoka (JP); Ryuji Okamura, Shizuoka (JP); Kazuto Hosoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 10/059,139

(22) Filed: Jan. 31, 2002

(65) Prior Publication Data

US 2002/0168859 A1 Nov. 14, 2002

(30) Foreign Application Priority Data

| | | |
|---|---|---|
| Jan. 31, 2001 | (JP) | 2001/023703 |
| Feb. 15, 2001 | (JP) | 2001/038477 |
| Aug. 29, 2001 | (JP) | 2001/259693 |
| Jan. 29, 2002 | (JP) | 2002/020492 |

(51) Int. Cl.[7] ..... G03G 5/082; G03G 5/147

(52) U.S. Cl. ..... 430/66; 430/67; 430/128; 430/132; 399/159

(58) Field of Search ..... 430/66, 67, 128, 430/132; 399/159

(56) References Cited

U.S. PATENT DOCUMENTS

| | | | | |
|---|---|---|---|---|
| 4,954,397 | A | 9/1990 | Amada et al. | 430/58 |
| 5,849,446 | A | 12/1998 | Hashizume et al. | 430/67 |
| 6,001,521 | A | 12/1999 | Hashizume et al. | 430/58.1 |
| 6,128,456 | A | 10/2000 | Chigono et al. | 399/176 |
| 6,531,253 | B2 * | 3/2003 | Ehara et al. | 430/66 |
| 6,534,228 | B2 * | 3/2003 | Kawada et al. | 430/66 |

FOREIGN PATENT DOCUMENTS

| | | |
|---|---|---|
| JP | 62-175781 | 8/1987 |
| JP | 62-189477 | 8/1987 |
| JP | 63-210864 | 9/1988 |
| JP | 64-86149 A | 3/1989 |
| JP | 04-191748 | 7/1992 |
| JP | 6-118741 | 4/1994 |
| JP | 07-064312 | 3/1995 |
| JP | 10-307455 | 11/1998 |
| JP | 11-2996 | 1/1999 |
| JP | 11-133640 | 5/1999 |
| JP | 11-133641 | 5/1999 |
| JP | 11-190927 | 7/1999 |

OTHER PUBLICATIONS

Patent Abstracts of Japan, vol. 016, No. 516, Oct. 23, 1992 (JP 04–191748, Jul. 10, 1992).
Patent Abstracts of Japan, vol. 1995, No. 06, Jul. 31, 1995 (JP 07–064312, Mar. 10, 1995).

* cited by examiner

*Primary Examiner*—John Goodrow
(74) *Attorney, Agent, or Firm*—Fitzpatrick, Cella, Harper & Scinto

(57) ABSTRACT

A process for producing an electrophotographic photosensitive member comprising the steps of depositing a non-single crystal material composed basically of silicon atoms, on a cylindrical substrate in a deposition chamber, thereafter once taking the substrate with film out of the deposition chamber, then returning it to the deposition chamber, and thereafter again depositing thereon a non-single-crystal material composed basically of carbon atoms. In another embodiment, the process comprises the steps of depositing on a cylindrical substrate a photoconductive layer formed of a non-single crystal material, subjecting to surface processing the deposited film having protrusions present at its surface, and depositing on the processed surface a surface protective layer formed of a non-single-crystal material. Also disclosed is the electrophotographic photosensitive member thus obtained, and an electrophotographic apparatus having that member.

44 Claims, 10 Drawing Sheets

(1 of 10 Drawing Sheet(s) Filed in Color)

ELECTROPHOTOGRAPHIC PHOTOSENSITIVE MEMBER, PROCESS FOR ITS PRODUCTION, AND ELECTROPHOTOGRAPHIC APPARATUS

BACKGROUND OF THE INVENTION

1. Field of the Invention

This invention relates to a photosensitive member used in electrophotographic apparatus, a process for its production, and an electrophotographic apparatus having this photosensitive member as a light-receiving member. More particularly, this invention relates to an amorphous-silicon (a-Si) type photosensitive member having an amorphous-carbon (a-C) surface protective layer; the photosensitive member having been so improved as to prevent occurrence of faulty images caused by the presence of protrusions standing uncovered to its surface and occurrence of any difficulties or troubles in the step of cleaning the light-receiving member surface in the course of forming electrophotographic images; and also relates to a process for producing such a photosensitive member, and an electrophotographic apparatus having such a photosensitive member as a light-receiving member and not causative of any faulty images and any difficulties or troubles in the cleaning step.

2. Related Background Art

In electrophotographic apparatus such as copying machines, facsimile machines and printers, first the periphery of a photosensitive member comprising a conductive cylindrical substrate provided on its surface with a photoconductive layer is uniformly electrostatically charged by the use of charging means such as corona charging, roller charging, fur brush charging or magnetic-brush charging. Next, light reflecting from an image to be copied, of an original document, or laser light or LED light corresponding to modulated signals of that image is used to expose the photosensitive member surface to form an electrostatic latent image on the periphery of the photosensitive member. Then, a toner is made to adhere to the photosensitive member surface to form a toner image from the electrostatic latent image, and the toner image is transferred to a copying paper or the like, thus a copy is taken (image formation).

After the copy has been taken in this way, the toner remains partly on the periphery of the photosensitive member, and hence such residual toner must be removed before the next copying step is carried on. Such residual toner is commonly removed by means of a cleaning unit making use of a cleaning blade, a fur brush or a magnet brush.

In recent years, in consideration of environment, electrophotographic apparatus are also proposed in which the above cleaning unit making use of a mechanical removal method is omitted for the purpose of reducing waste toner or eliminating waste toner, and some have already been on the market. The residual-toner removal method used in this electrophotographic apparatus includes, e.g., a method in which a direct-charging assembly such as a brush charging assembly as disclosed in Japanese Patent Application Laid-Open No. 6-118741 is used to carry out both a cleaning step and a charging step, and a method in which a developing assembly as disclosed in Japanese Patent Application Laid-Open No. 10-307455 (corresponding to U.S. Pat. No. 6,128,456) is used to carry out both a cleaning step of collecting the residual toner and a developing step of making the toner adhere. Either of the above cleaning methods has a step in which the toner and the photosensitive member surface are brought into rubbing friction to remove the toner.

Meanwhile, in recent years, in order to achieve higher image quality of printed images, it is put forward to use toners having a smaller average particle diameter than ever or to use toner having a lower melting point so as to be adaptable to energy saving. At the same time, with advancement of surrounding electric circuit devices, the copying speed of electrophotographic apparatus, i.e., the number of revolutions of photosensitive members is being made higher and higher. Under such circumstances, with an increase in the copying speed and frequency of electrophotographic apparatus, a phenomenon has come to occur in which the residual toner causes its melt adhesion to the photosensitive member surface. In particular, in recent years, with advancement of digitization of electrophotographic apparatus, the demand on image quality is more and more raised in level to have reached a situation that even image defects at a level tolerable in conventional analog-type apparatus must be regarded as questionable. Accordingly, it is demanded to remove factors causative of such image defects and, in respect of the occurrence of melt adhesion caused by the residual toner, too, to take any effective countermeasures for eliminating or preventing it.

The cause of the occurrence of melt adhesion or filming has not been elucidated in detail, but its occurrence is roughly estimated to be due to the following factors. For example, in the cleaning step making use of a cleaning blade or the like, the frictional force acting between the photosensitive member and the part rubbing against it (rubbing part) may cause a phenomenon of chattering in the state of contact. With this phenomenon, the effect of compression against the photosensitive member surface may become higher, so that the residual toner may strongly be pressed against the photosensitive member to cause the melt adhesion or filming. In addition, with an increase in process speed for the image formation of electrophotographic apparatus, the relative speed between the rubbing part and the photosensitive member increases more and more, and hence this also makes it tend to bring about the situation for the cause of occurrence.

As countermeasures for keeping the melt adhesion or filming from occurring, which is caused by the frictional force acting between the photosensitive member and the rubbing part, it is proposed, as disclosed in Japanese Patent Application Laid-Open No. 11-133640 (corresponding to U.S. Pat. No. 6,001,521) and Japanese Patent Application Laid-Open No. 11-133641 (corresponding to U.S. Pat. No. 6,001,521), that an amorphous carbon layer containing hydrogen (hereinafter "a-C:H film") is used as a surface protective layer of a photosensitive member, and such a layer is shown to be effective. This a-C:H film, as it is also called diamond-like carbon (DLC), has a very high hardness. Hence, it can prevent scratches and wear and in addition thereto has a peculiar solid lubricity. From these two characteristics, it is considered to be an optimum material for preventing the melt adhesion or filming.

However, this a-C:H film and an amorphous silicon (hereinafter "a-Si") film used in a photoconductive layer may differ in optimum production conditions. More specifically, in the case of a-Si photosensitive members, it is common to set substrate temperature to 200° C. to 450° C. in order to attain practical characteristics. On the other hand, in the case of the a-C:H film, it is better for the substrate temperature to be set low to obtain a good film, and hence, the film is often formed setting the substrate temperature at room temperature to about 150° C. Accordingly, when a surface layer comprised of a-C:H is deposited on a photosensitive member having a photoconductive layer formed basically of a-Si, it has been necessary to lower to room temperature to about 150° C. the substrate temperature set to 200° C. to 450° C., and thereafter form the a-C:H surface layer. In many deposition chambers, a heater for heating substrates is built in to control the temperature of substrates, but, in many cases, any member for cooling is not provided. Accordingly, it has been inevitable to rely on natural heat dissipation in order to lower to room temperature to about 150° C. the substrate temperature having been kept at 200° C. to 450° C., so that it has taken a very long time especially in vacuum environment. Hence, there has been a problem that photosensitive members are producible only in a small number per day per one deposition chamber, resulting in a cost increase for the manufacture of photosensitive members.

As another problem, when the photosensitive members thus produced taking a long time are inspected for shipment after their completion, defectives may occur which make products unacceptable, because of unexpected poor image formation or poor potential. Such occurrence of defectives has also been a factor for the cost increase.

Apart from the foregoing, in the case of a-Si photosensitive members, as a problem on their production processes, it is also known, as disclosed in Japanese Patent Application Laid-Open No. 62-189477, that protrusions often occur at the surfaces of deposited films. Many proposals are made on how to keep such protrusions from occurring, but it is considered very difficult in respect of techniques and also in respect of cost to make the protrusions not occur at all which arise from minute foreign matter having accidentally adhered to the surface.

At the part of such protrusions, the melt adhesion of a developer (toner particles) tends to occur. Even in an attempt to use the a-C:H film in the surface protective layer to keep the melt adhesion from occurring at normal areas except the protrusions, it has not been made able to perfectly prevent so far as the occurrence of melt adhesion at the part of protrusions.

In addition, the photosensitive member is, when used inside the electrophotographic apparatus, rubbed with any members coming into contact therewith and becomes worn, in the course of charging, development, transfer and cleaning. In that course, compared with the part of normal areas, the part of protrusions may selectively greatly wear because of its peculiarity in shape. Moreover, what has not been image defects at the initial stage may come to image defects because of a lowering of charge retentivity as a result of the wearing at the part of vertexes of the protrusions. Also, the part having worn at the protrusion vertexes comes not having any surface protective layer formed of a-C:H film (hereinafter often simply "a-C surface layer") to cause melt adhesion at that part as the starting point. Thus, such wearing has a possibility of coming to a factor which deteriorates image characteristics.

In this connection, in a system where the chief cause of wear is the rubbing friction acting in the cleaning step, the wear at the part of normal areas is at a level of about 1 nm per 10,000 sheets when an amorphous silicon carbide (a-SiC) surface layer is used. Also, in a system where the chief cause of wear is a contact charging step involving a high rubbing frictional force, the wear at the part of normal areas is at a level of about 10 nm per 10,000 sheets in the case of the a-SiC surface layer, whereas, it is approximately at a level of about 1 nm per 10,000 sheets in the case of the a-C surface layer.

In addition, in a system where a cleaning blade is commonly used, the blade may be damaged or broken off because of the protrusions to cause what is called the developer (toner) escape, so that there is also a possibility of causing faulty cleaning.

SUMMARY OF THE INVENTION

The present invention is to solve the problems discussed above. Accordingly, an object of the present invention is to provide an electrophotographic photosensitive member which, in the system making use chiefly of the a-C surface layer, does not cause the above difficulties incidental to the protrusions occurring when the a-Si film of the photoconductive layer is formed, so as to have a higher reliability, and a process for producing such a photosensitive member.

Another, final object of the present invention is to provide an electrophotographic apparatus having such an electrophotographic photosensitive member having a higher reliability.

Stated more specifically, an object of the present invention is to provide an electrophotographic photosensitive member which, even where the protrusions have occurred when the a-Si film of the photoconductive layer is formed, can prevent occurrence of any melt adhesion or filming arising from protrusions, can also prevent occurrence of any image defects incidental to the selective wear at the protrusions, and at the same time can exhibit advantages attributable to the use of the a-C surface layer; and a process for producing such a photosensitive member.

More specifically, to achieve the above objects, the present invention provides a process for producing an electrophotographic photosensitive member formed of at least a non-single-crystal material; the process comprising the steps of:

as a first step, placing a cylindrical substrate having a conductive surface, in a deposition chamber having at least an evacuation means and a material gas feed means and capable of being made vacuum-airtight, and decomposing a material gas by means of a high-frequency electric power to deposit on the cylindrical substrate a first layer formed of at least a non-single-crystal material;

as a second step, exposing to the atmosphere the cylindrical substrate on which the first layer has been deposited; and as a third step, decomposing a material gas by means of a high-frequency electric power to further deposit on the first layer a second layer formed of at least a non-single-crystal material.

The present invention also provides an electrophotographic photosensitive member produced by the above production process, and an electrophotographic apparatus making use of the electrophotographic photosensitive member.

The present invention still also provides an electrophotographic photosensitive member comprising a cylindrical substrate formed of a conductive material; a photoconductive layer formed of a non-single-crystal material, deposited on the cylindrical substrate; and a surface protective layer formed of a non-single-crystal material, deposited on the photoconductive layer;

the photoconductive layer being a layer formed of a non-single-crystal material which is deposited on the cylindrical substrate by decomposing a material gas by means of a high-frequency electric power in a deposition chamber having at least an evacuation means and a material gas feed means and capable of being made vacuum-airtight, to form a deposited film; the deposited film being thereafter subjected to surface processing to have a processed surface; and the surface protective layer being a layer formed of a non-single-crystal material which is deposited on the photoconductive layer having the processed surface, by decomposing a material gas by means of a high-frequency electric power in a deposition chamber having at least an evacuation means and a material gas feed means and capable of being made vacuum-airtight.

The present invention further provides a process for producing an electrophotographic photosensitive member comprising a cylindrical substrate formed of a conductive material; a photoconductive layer formed of a non-single-crystal material, deposited on the cylindrical substrate; and a surface protective layer formed of a non-single-crystal material, deposited on the photoconductive layer; the process comprising the steps of:

a first step of depositing the photoconductive layer on the cylindrical substrate in a stated layer thickness by decomposing a material gas by means of a high-frequency electric power in a deposition chamber having at least an evacuation means and a material gas feed means and capable of being made vacuum-airtight, to form a deposited film;

a second step of subjecting the deposited film formed in the first step, to surface processing; and a third step of depositing the surface protective layer on the surface of the photoconductive layer having been subjected to surface processing in the second step, by decomposing a material gas by means of a high-frequency electric power in a deposition chamber having at least an evacuation means and a material gas feed means and capable of being made vacuum-airtight, to form a deposited film in a stated layer thickness.

The present invention still further provides an electrophotographic apparatus comprising a photosensitive member comprising a cylindrical substrate; a photoconductive layer formed of a non-single-crystal material, deposited on the cylindrical substrate; and a surface protective layer formed of a non-single-crystal material, deposited on the photoconductive layer;

in the photosensitive member;

the cylindrical substrate being a cylindrical substrate formed of a conductive material;

the photoconductive layer being a layer formed of a non-single-crystal material which is deposited on the cylindrical substrate by decomposing a material gas by means of a high-frequency electric power in a deposition chamber having at least an evacuation means and a material gas feed means and capable of being made vacuum-airtight, to form a deposited film; the deposited film being thereafter subjected to surface processing to have a surface from which vertexes of protrusions which had been present at the surface have been removed; and the surface protective layer being a layer formed of a non-single-crystal material which is deposited on the photoconductive layer having the processed surface, by decomposing a material gas by means of a high-frequency electric power in a deposition chamber having at least an evacuation means and a material gas feed means and capable of being made vacuum-airtight.

BRIEF DESCRIPTION OF THE DRAWINGS

The patent or application file contains at least one drawing executed in color. Copies of this patent or patent application publication with color drawings will be provided by the Office upon request and payment of the necessary fee.

DESCRIPTION OF THE PREFERRED EMBODIMENTS

Figure 1:
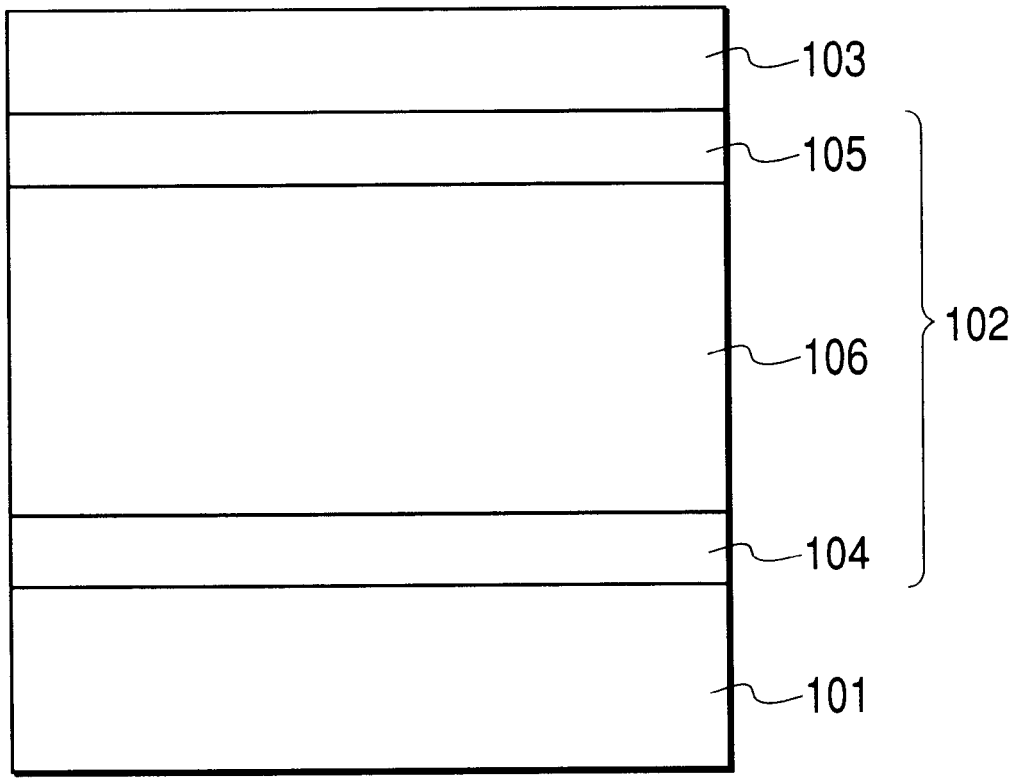
FIG. 1 is a diagrammatic sectional view of an example of layer construction of the electrophotographic photosensitive member of the present invention.

The present inventors have made studies on a-Si photosensitive members making use of an a-C layer, having a high melt adhesion preventive effect, as a surface layer, where, as stated previously, they have become aware of the fact that the optimum substrate temperature differs between the photoconductive layer a-Si layer and the surface layer a-C layer. Then, they have noticed that, when films are continuously formed through an integrated production procedure from the photoconductive layer to the surface layer, the substrate temperature must be changed in the middle of film formation in order to form the respective layers at optimum substrate temperatures, and it takes a fairly long time for such film formation, resulting in a decrease in production efficiency of the deposition chamber. What is especially questioned is that it is necessary to cool the substrate in the middle of film formation because the substrate temperature most suited for the formation of the a-Si photoconductive layer is as high as 200° C. to 450° C. and the substrate temperature most suited for the formation of the a-C layer surface layer is room temperature to about 150° C. In conventional deposition chambers, a heater for heating substrates is provided, but any cooling means is not provided, and hence the cooling rate is inevitably low. In addition, since the inside of the deposition chamber is set vacuum and is in a kind of heat-insulating state, it has taken a very long time to cool substrates.

To solve this problem, the present inventors made extensive studies. They have once had an idea of a method in which, in order to change the substrate temperature swiftly, a substrate holder is internally provided with a cooling means as exemplified by a water cooling pipe, to cool the substrate forcibly. However, it is difficult to provide the heater and the cooling pipe simultaneously, also bringing about a problem that such a method results in a cost increase of the production system. Also, although the heating can be effected by radiation heat in a good efficiency even in vacuum, such a technique can not be used for the cooling. Hence, even if the cooling means such as a cooling pipe is provided, it is impossible to shorten the cooling time to a satisfactory extent.

Accordingly, the present inventors have changed the conception that films are formed continuously from the a-Si photoconductive layer to the a-C surface layer, and instead have had an idea of a process in which films are first formed up to the a-Si photoconductive layer, thereafter the photosensitive member which is being produced is once exposed to the atmosphere and then the a-C surface layer is formed. As a method of exposing it to the atmosphere, it is preferable to take it once out of the deposition chamber. After the photosensitive member on which films have been formed up to the a-Si photosensitive layer has been taken out, the deposition chamber may immediately be sent to the subsequent film formation process, e.g., to cleaning to be carried out by dry etching in the deposition chamber, thus the chamber can be used for the production without loss. Meanwhile, the unfinished a-Si photosensitive member taken out is spontaneously cooled and thereafter returned to (again set in) the deposition chamber, and then the a-C layer is formed there, thus the film can be formed at the optimum, low substrate temperature of from room temperature to 150° C.

In the case when such a cycle is taken, it follows that, when the next film is formed, it is done in the state the a-C layer has been deposited also on inner walls of the deposition chamber. It has been ascertained that, since the a-C layer originally functions also as an adherent layer, the adherence of films to inner walls of the deposition chamber is more improved, and the effect of preventing films from coming off from the inner walls can also be obtained, consequently making it possible to improve production efficiency.

It has also been ascertained that, as a result of the cleaning carried out by dry etching in the state the a-C layer and the a-Si photoconductive layer have been deposited in the deposition chamber, not only the a-Si photoconductive layer but also the a-C layer can cleanly be etched. Usually, the a-C layer can be etched at a low rate, having properties of being etched with difficulty. However, it is presumed that the dry etching carried out in the presence of the a-Si type film causes any chemical acceleration reaction to take place to bring about an increase in etching rate.

The above cycle may sufficiently be effective also when taken for each photosensitive member. Of course, it may be taken on a plurality of members together. For example, films up to the a-Si photoconductive layer may be kept formed beforehand on a certain number of substrates, and thereafter the a-C layer as the surface layer may continuously be formed thereon.

A secondary advantage of the present invention is that the photosensitive member on which films up to the a-Si layer have been formed can be inspected when it is taken out of the deposition chamber. As the inspection, for example the external appearance may be inspected to check any defectives due to peeling or spherical protrusions. Also, in the case of a photosensitive member provided with an intermediate layer to be formed between the photoconductive layer and the surface layer as one construction of the photosensitive member, image inspection and potential characteristics inspection may also be made as the inspection. When any defectives are found in such inspection, the subsequent film formation can be stopped at that point of time. Hence, any lowering of operating efficiency or any waste of material gases can be prevented, bringing about an advantage that the cost can further be reduced as a production line.

Incidentally, in respect of any influence when the photosensitive member on which films up to the a-Si layer have been formed is taken out of the deposition chamber, no particular difference was seen in electrical characteristics and image characteristics, from the case of continuous film formation. Also, no practically problematic evil was seen in respect of the surface layer adherence. However, especially where the photoconductive layer has come into contact with ozone when, e.g., the above image inspection and potential characteristics inspection are made, it is preferable to wash the photosensitive member surface with water before the surface layer is formed, in the sense of a more improvement of adherence. Also, as another method, it is preferable to etch the photosensitive member surface gently with a gas such as fluorine before the surface layer is formed. In view of an improvement in adherence, it is also preferable to apply the both in combination.

The present inventors further pushed their studies forward in order to solve the problems on protrusions, discussed previously. In that case, as a method of reducing protrusions which is conventionally proposed, a technique is disclosed in, e.g., Japanese Patent Application Laid-Open No. 11-2996 in which, after a photosensitive member has been produced, its surface is polished to make the height of protrusions small. In this method, after the a-C surface layer has been formed, the vertexes of protrusions are polished away to provide the shape (surface profile) as shown in FIG. 10C. The final surface profile shown in FIG. 10C has been found not necessarily preferable because there is a possibility of causing faulty images from the initial stage as stated previously, or being the starting point of causing the melt adhesion.

Figure 10A:
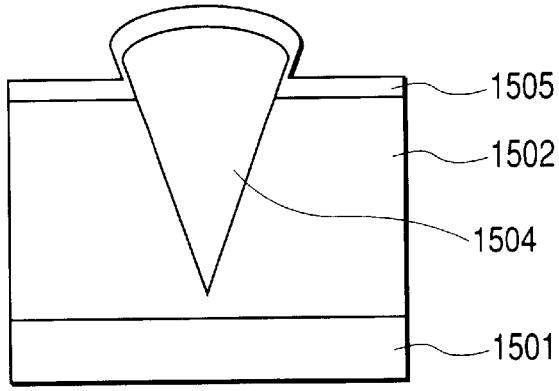
FIGS. 10A, 10B and 10C are diagrammatic sectional views of an example of the construction of a conventional electrophotographic photosensitive member.
Figure 10B:
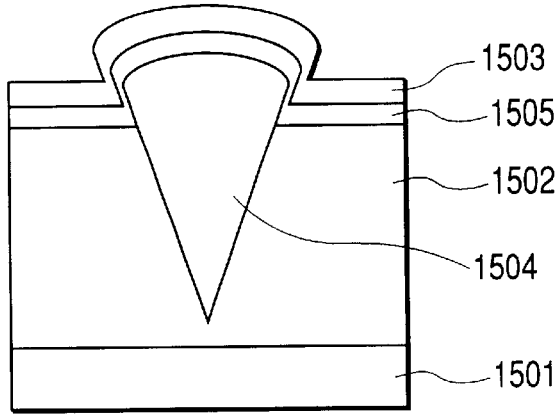
Figure 10C:
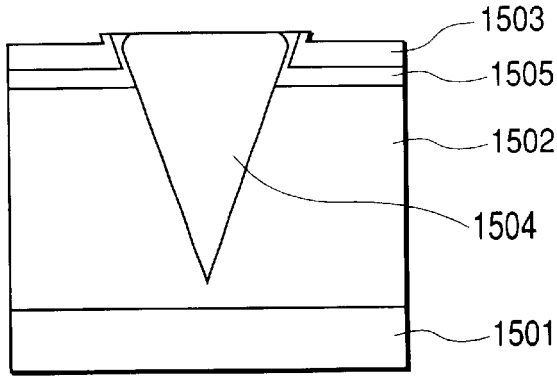

FIGS. 10A to 10C show in greater detail an example of an electrophotographic photosensitive member in which, after the a-C surface layer has been formed, the vertexes of protrusions have been made flat by polishing. For example, on a cylindrical substrate 1501 formed of a conductive material such as aluminum or stainless steel, a photoconductive layer 1502, an intermediate layer 1505 and a surface protective layer 1503 have been deposited in order, where a protrusion 1504 has occurred during the formation of the photoconductive layer 1502. In FIGS. 10A to 10C, FIG. 10A is a diagrammatic sectional view of the protrusion at a stage where films have been formed up to the intermediate layer 1505; FIG. 10B a diagrammatic sectional view of the protrusion at a stage where films have been formed up to the surface protective layer 1503; and FIG. 10C a diagrammatic sectional view of a state where the vertex of the protrusion has been made flat by polishing after the surface protective layer 1503 has been formed.

The material of the protrusion 1504 is substantially the same as that of the surrounding photoconductive layer 1502. The intermediate layer 1505 and surface protective layer 1503 deposited thereafter are so formed as to extend after the shape of the protrusion. FIG. 10C shows a state where the vertex has been polished away by means of a polishing apparatus as described later.

The present inventors further made extensive studies on any means by which the difficulties and problems incidental to the protrusions can be solved, in place of the conventional method. As the result, they have discovered that, before the surface protective layer is formed, the deposited film may be subjected to surface-smoothing processing, e.g., polishing to remove the vertexes of protrusions standing uncovered to its surface, and then the surface protective layer formed as the a-C surface layer at the outermost surface may be deposited and superposed on the deposited film surface having been made flat, whereby the resultant electrophotographic photosensitive member can have electrophotographic performance which does almost not differ between the part where the protrusions had originally been present and the part of normal areas. In particular, an electrophotographic photosensitive member having uniform and superior image characteristics, which can prevent occurrence of any melt adhesion or filming arising from protrusions, can also prevent occurrence of any image defects incidental to the selective wear at the protrusions and further can exhibit advantages attributable to the use of the a-C surface layer, is obtainable in a high reproducibility. Thus, with such discovery, they have accomplished the present invention.

With regard to the prevention of occurrence of any melt adhesion or filming arising from protrusions and the prevention of occurrence of any image defects incidental to the selective wear at the protrusions, the photosensitive member can have advantages as stated later and can show the highest effect when its outermost surface is the a-C surface layer. However, the range in which its effect is brought out is by no means limited to the case when the outermost surface is the a-C surface layer, and is applicable more generally. It has been discovered that a more preferred embodiment can be provided especially when the a-C surface layer is used. Thus, the present invention has been accomplished which is applicable to a wider range.

In the electrophotographic photosensitive member according to the present invention, the non-single-crystal material used in the photoconductive layer and surface protective layer may include not only amorphous materials but also microcrystalline materials and polycrystalline materials. In general, amorphous materials may more preferably be used.

The present invention is described below in greater detail with reference to the accompanying drawings as occasion calls.

(a-Si Photosensitive Member According to the Present Invention)

FIG. 1 shows an example of layer construction of the electrophotographic photosensitive member according to the present invention.

The electrophotographic photosensitive member of this example comprises a substrate 101 comprised of a conductive material as exemplified by aluminum or stainless steel, and deposited thereon a first layer 102 and a second layer 103 in order. In the present invention, a-Si may preferably be used as a material for a photoconductive layer 106, included in the first layer, and a-C as a material for the second layer, surface layer 103.

The photoconductive layer 106 may optionally be provided on its substrate side with a lower-part blocking layer 104. The lower-part blocking layer 104 may be incorporated with a dopant such as a Group 13 element or a Group 15 element of the periodic table under appropriate selection to enable control of charge polarity, i.e., positive charging or negative charging.

An intermediate layer 105 may further optionally be provided between the photoconductive layer 106 and the surface layer 103. To provide the intermediate layer 105, three patterns are considered usable, i.e., a method in which it is formed in a first step and thereafter the unfinished member is once taken out and again returned to the deposition chamber to form the surface layer subsequently, a method in which films up to the photoconductive layer are formed in a first step and thereafter the unfinished member is once taken out and again returned to the deposition chamber to form the intermediate layer and the surface layer, and a method in which the intermediate layer is formed in each of the first step and second step. Also, the intermediate layer may preferably be formed of a non-single-crystal material composed chiefly of silicon atoms and containing at least one of carbon atoms, nitrogen atoms and oxygen atoms.

(Shape and Material of Substrate)

The substrate may have any desired shape according to how the electrophotographic photosensitive member is driven. For example, it may be in the shape of a cylinder or a sheetlike endless belt, having smooth surface or uneven surface. Its thickness may appropriately be determined so that the electrophotographic photosensitive member can be formed as desired. Where a flexibility is required as electrophotographic photosensitive members, the substrate may be as thin as possible as long as it can sufficiently function as a cylinder. In view of production and handling and from the viewpoint of mechanical strength, however, the cylinder should have a wall thickness of 1 mm or more in usual cases. When the sheetlike endless belt is used, the belt should have a thickness of 10 $\mu$m or more in usual cases.

As materials for the substrate, conductive materials such as aluminum and stainless steel as mentioned above are commonly used. Also usable are, e.g., materials not particularly having any conductivity, such as plastic, glass and ceramics of various types, but provided with conductivity by vacuum deposition or the like of a conductive material on their surfaces at least on the side where the photoconductive layer is formed.

The conductive material may include, besides the foregoing, metals such as Cr, Mo, Au, In, Nb, Te, V, Ti, Pt, Pd and Fe, and alloys of any of these.

The plastic may include films or sheets of polyester, polyethylene, polycarbonate, cellulose acetate, polypropylene, polyvinyl chloride, polystyrene or polyamide.

(a-Si Photoconductive Layer According to the Present Invention)

The photoconductive layer 106 in the present invention is constituted of a non-single-crystal material composed chiefly of silicon atoms and further containing hydrogen atoms and/or halogen atoms (hereinafter abridged "a-Si(H, X)").

The a-Si(H,X) film may be formed by plasma-assisted CVD (chemical vapor deposition), sputtering or ion plating. Films prepared by the plasma-assisted CVD are preferred because films having especially high quality can be obtained. As materials therefor, gaseous or gasifiable silicon hydrides (silanes) such as $SiH_4$, $Si_2H_6$, $Si_3H_8$ and $Si_4H_{10}$ may be used as materials gases, any of which may be decomposed by means of a high-frequency electric power to form the film. In view of readiness in handling for layer formation and Si-feeding efficiency, $SiH_4$ and $Si_2H_6$ are preferred.

Here, the substrate temperature may preferably be kept at a temperature of from 200° C. to 450° C., and more preferably from 250° C. to 350° C., in view of characteristics. This is to accelerate the surface reaction at the substrate surface to effect structural relaxation sufficiently. In any of these gases, a gas containing $H_2$ or halogen atoms may further be mixed in a desired quantity. This is preferred in order to improve characteristics. What is effective as material gases for feeding halogen atoms may include fluorine gas ($F_2$) and interhalogen compounds such as BrF, ClF, $ClF_3$, $BrF_3$, $BrF_5$, $IF_3$ and $IF_7$. It may also include silicon compounds containing halogen atoms, what is called silane derivatives substituted with halogen atoms, including silicon fluorides such as $SiF_4$ and $Si_2F_6$, as preferred ones. Also, any of these gases may optionally be diluted with $H_2$, He, Ar or Ne when used.

There are no particular limitations on the layer thickness of the photoconductive layer 106. It may suitably be from about 15 to 50 $\mu$m taking account of production cost and so forth.

The photoconductive layer 106 may also be formed in multiple layer construction in order to improve characteristics. For example, photosensitivity and charging performance can simultaneously be improved by disposing on the surface side a layer having a narrower band gap and on the substrate side a layer having a broader band gap. The designing of such layer construction brings about a dramatic effect especially in respect of light sources having a relatively long wavelength and also having little scattering in wavelength as in the case of semiconductor lasers.

For the purpose of improving the mobility of carries and improving charging performance, the photoconductive layer 106 may optionally be incorporated with a dopant. A Group 13 element of the periodic table may be used as the dopant, which may specifically include boron (B), aluminum (Al), gallium (Ga), indium (In) and thallium (Tl). In particular, B and Al are preferred. A Group 15 element may also be used, which may specifically include phosphorus (P), arsenic (As), antimony (Sb) and bismuth (Bi). In particular, P is preferred.

The dopant atoms may be in a content of from $1\times10^{-2}$ to $1\times10^{4}$ atomic ppm, more preferably from $5\times10^{-2}$ to $5\times10^{3}$ atomic ppm, and most preferably from $1\times10^{-1}$ to $1\times10^{3}$ atomic ppm.

Materials for incorporating such a Group 13 element may specifically include, as a material for incorporating boron atoms, boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. Besides, the material may also include $AlCl_3$, $GaCl_3$, $Ga(CH_3)_3$, $InCl_3$ and $TlCl_3$. In particular, $B_2H_6$ is one of preferred materials also from the viewpoint of handling.

What can effectively be used as materials for incorporating the Group 15 element may include, as a material for incorporating phosphorus atoms, phosphorus hydrides such as $PH_3$ and $P_2H_4$ and phosphorus halides such as $PF_3$, $PF_5$, $PCl_3$, $PCl_5$, $PBr_3$ and $PI_3$. It may further include $PH_4I$. Besides, the starting material for incorporating the Group 15 element may also include, as those which are effective, $ASH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$.

The intermediate layer 105, which may optionally be provided, may preferably be constituted of a-Si(H,X) as a base and a material containing at least one element selected from C, N and O, and may more preferably be formed of a-SiC(H,X), which is composition intermediate between the a-Si photoconductive layer and the a-C surface layer. In this case, the compositional ratio of the elements constituting the intermediate layer 105 may continuously be changed from the photoconductive layer 106 toward the surface layer 103, as being effective for the prevention of interference and so forth.

In the present invention, the intermediate layer 105 must be incorporated with hydrogen atoms and/or halogen atoms. This is essential and indispensable in order to compensate unbonded arms of silicon atoms to improve layer quality, in particular, to improve photoconductive performance and charge retention performance. The hydrogen atoms may preferably be in a content of from 30 to 70 atomic % in usual cases, and preferably from 35 to 65 atomic %, and most preferably from 40 to 60 atomic %, based on the total content of constituent atoms. Also, the halogen atoms may preferably be in a content of from 0.01 to 15 atomic % in usual cases, and preferably from 0.1 to 10 atomic %, and most preferably from 0.5 to 5 atomic %, based on the total content of constituent atoms.

Material gases used to form the intermediate layer 105 in the present invention may preferably include the following.

Materials that can serve as gases for feeding carbon may include, as those effectively usable, gaseous or gasifiable hydrocarbons such as $CH_4$, $C_2H_6$, $C_3H_8$ and $C_4H_{10}$.

Materials that can serve as gases for feeding nitrogen or oxygen may include, as those effectively usable, gaseous or gasifiable compounds such as $NH_3$, NO, $N_2O$, $NO_2$, $O_2$, CO, $CO_2$ and $N_2$.

As materials that can serve as gases for feeding silicon, those used for forming the photoconductive layer may be used.

The intermediate layer 105 may be formed by plasma-assisted CVD, sputtering or ion plating. Also, as discharge frequency of the power used in plasma-assisted CVD when the intermediate layer 105 in the present invention is formed, any frequency may be used. In an industrial scale, preferably usable is high-frequency power of from 1 MHz to 50 MHz, which is called an RF frequency band, or high-frequency power of from 50 MHz to 450 MHz, which is called a VHF band.

When the intermediate layer 105 is deposited, the conductive-substrate temperature may preferably be regulated to from 50° C. to 450° C., and more preferably from 100° C. to 300° C.

When the lower-part blocking layer 104 is provided, the a-Si(H,X) may commonly be used as a base and the dopant such as a Group 13 element or a Group 13 element of the periodic table may be incorporated to control its conductivity type, so as to be able to have the ability to block the injection of carriers from the substrate. In this case, at least one element selected from C, N and O may optionally be incorporated to regulate stress to make this layer have the function to improve the adherence of the photoconductive layer 106.

As the Group 13 element or Group 15 element used as the dopant of the lower-part blocking layer 104, those described above may be used. The dopant atoms may preferably be in a content of from $1\times10^{-2}$ to $1\times10^{4}$ atomic ppm, more preferably from $5\times10^{-2}$ to $5\times10^{3}$ atomic ppm, and most preferably from $1\times10^{-1}$ to $1\times10^{3}$ atomic ppm.

(a-C Surface Layer According to the Present Invention)

The surface layer 103 formed as the second layer comprises non-single-crystal carbon. What is herein meant by "non-single-crystal carbon" chiefly indicates amorphous carbon having a nature intermediate between graphite and diamond, and may also partly contain a microcrystalline or polycrystalline component. This surface layer 103 has a free surface, and is provided chiefly in order to achieve what is aimed in the present invention, i.e., the prevention of melt adhesion, scratching and wear in long-term service.

The surface layer 103 of the present invention may be formed by plasma-assisted CVD, sputtering, ion plating or the like, using as a material gas a hydrocarbon which is gaseous at normal temperature and normal pressure. Films formed by plasma-assisted CVD have both a high transparency and a high hardness, and is preferable for their use as surface layers of photosensitive members. Also, as discharge frequency of the power used in plasma-assisted CVD when the surface layer 103 of the present invention is formed, any frequency may be used. In an industrial scale, preferably usable is high-frequency power of 1 to 50 MHz, which is called an RF frequency band, in particular, 13.56 MHz. Also, especially when high-frequency power of a frequency band of from 50 to 450 MHz is used, which is called VHF, the film formed can have both a higher transparency and a higher hardness, and is more preferable for its use as the surface layer.

Materials that can serve as gases for feeding carbon may include, as those effectively usable, gaseous or gasifiable hydrocarbons such as $CH_4$, $C_2H_2$, $C_2H_6$, $C_3H_8$ and $C_4H_{10}$. In view of readiness to handle and carbon feed efficiency at the time of layer formation, $CH_4$, $C_2H_2$ and $C_2H_6$ are preferred. Also, any of these carbon-feeding material gases may further optionally be diluted with a gas such as $H_2$, He, Ar or Ne when used.

In the case of the a-C surface layer, the substrate temperature may preferably be a low temperature. This is because graphite components may increase with an increase in substrate temperature to bring about undesirable influences such as a lowering of hardness, a lowering of transparency and a lowering of surface resistance. Accordingly, the substrate temperature may be set at from 20° C. to 150° C., and preferably at about room temperature.

In order to attain the effect of the present invention, the surface layer 103 may further contain hydrogen atoms. Incorporation of hydrogen atoms effectively compensates any structural defects in the film to reduce the density of localized levels. As the result, the transparency of the film is improved and, in the surface layer, any unwanted absorption of light is kept from taking place, bringing about an improvement in photosensitivity. Also, the presence of hydrogen atoms in the film is said to play an important role for the solid lubricity.

The hydrogen atoms may be in a content having the value in the range of from 10 atomic % to 60 atomic %, and preferably from 35 atomic % to 55 atomic %. If they are in a content less than 35 atomic %, the above effect is not obtainable in some cases. If on the other hand they are in a content more than 55 atomic %, the a-C film may have so low a hardness as to be unsuitable as the surface layer of the photosensitive member.

The a-C surface layer of the present invention may further optionally be incorporated with halogen atoms.

The surface layer 103 may also be divided into two layers on the side close to the photoconductive layer and on the side distant therefrom, and be so constructed that hydrogen atoms are added to the former (first surface layer) and halogen atoms, in particular, fluorine atoms are added to the latter (second surface layer). In such construction, conditions are so set that the first surface layer has a hardness (dynamic hardness) higher than that of the second surface layer. For example, when fluorine is added, it may be added in a content of from 6 atomic % to 50 atomic %, and preferably from 30 atomic % to 50 atomic %.

The surface layer is favorably usable as long as it has an optical band gap in a value of approximately from 1.2 to 2.2 eV, and preferably 1.6 eV or more in view of sensitivity. The surface layer is favorably usable as long as it has a refractive index of approximately from 1.8 to 2.8.

In the present invention, the surface layer 103 is preferably usable also when it further contains silicon atoms. Incorporation of silicon atoms can make the optical band gap broader, and is preferable in view of sensitivity. Too many silicon atoms, however, may make resistance to melt adhesion or filming poor, and hence their content must be determined balancing the band gap. The relationship between this silicon atom content and the melt adhesion or filming is known to be influenced also by the substrate temperature at the time of film formation. More specifically, in the case of the a-C surface layer incorporated with silicon atoms, the resistance to melt adhesion or filming can be improved when the substrate temperature is a little lower. Accordingly, in the case when the a-C surface layer incorporated with silicon atoms is used as the surface layer of the present invention, the substrate temperature may preferably be determined within the range of from 20° C. to 150° C., and preferably at about room temperature.

The content of the silicon atoms used in the present invention may appropriately be changed depending on various production conditions, substrate temperature, material gas species and so forth. Typically, it may preferably be in the range of from 0.2 to 10 atomic % as the ratio of silicon atoms to the sum of silicon atoms and carbon atoms.

Materials that can serve as gases for feeding silicon atoms may include, as those effectively usable, gaseous or gasifiable silicon hydrides (silanes) such as $SiH_4$, $Si_2H_6$, $Si_3H_8$ and $Si_4H_{10}$. In view of readiness in handling at the time of film formation and Si-feeding efficiency, $SiH_4$ and $Si_2H_6$ are preferred.

With regard to discharge space pressure, it may preferably be a relatively high vacuum because, when films are formed using not readily decomposable material gases such as hydrocarbons, polymers tend to be produced when any species to be decomposed collide against one another in the gaseous phase. It may preferably be kept at from 13.3 Pa to 1,330 Pa, and preferably from 26.6 Pa to 133 Pa, when usual RF (typically 13.56 MHz) power is used; and from 13.3 mPa to 1,330 Pa, and preferably from 66.7 mPa to 66.7 Pa, when VHF band (typically 50 to 450 MHz) power is used.

With regard to the discharge electric power, its optimum range may also similarly appropriately be selected according to layer designing. In usual cases, it may preferably be set in the range of from 0.5 to 30, more preferably from 0.8 to 20, and most preferably from 1 to 15, as the ratio (W/min/mL (normal)) of discharge electric power to flow rate of gas for feeding carbon. Also, it may continuously or stepwise be changed within the above range as occasion calls. The discharge electric power may preferably be as high as possible because the decomposition of hydrocarbons proceeds sufficiently, but may preferably at a level not causative of any abnormal discharge.

The surface layer may have a layer thickness of from 5 nm to 1,000 nm, and preferably from 10 nm to 200 nm. As long as it is 5 nm thick or more, it can have a sufficient mechanical strength. As long as it is not thicker than 1,000 nm, no problem may occur at all also on photosensitivity.

In the present invention, the unfinished photosensitive member once taken out from the deposition chamber after films have been formed up to the photoconductive layer 106 or intermediate layer 105 is then again set in the deposition chamber, where plasma discharge may be raised using a fluorine-containing gas or hydrogen gas to carry out etching to remove the surface thinly, and thereafter the a-C surface layer may be deposited. In this case, any oxide layer at the surface and any unnecessary interface are removed, and hence the effect of improving the adherence of the a-C surface layer can be obtained.

(a-Si Photosensitive Member Film Forming Apparatus According to the Present Invention)

Figure 2:
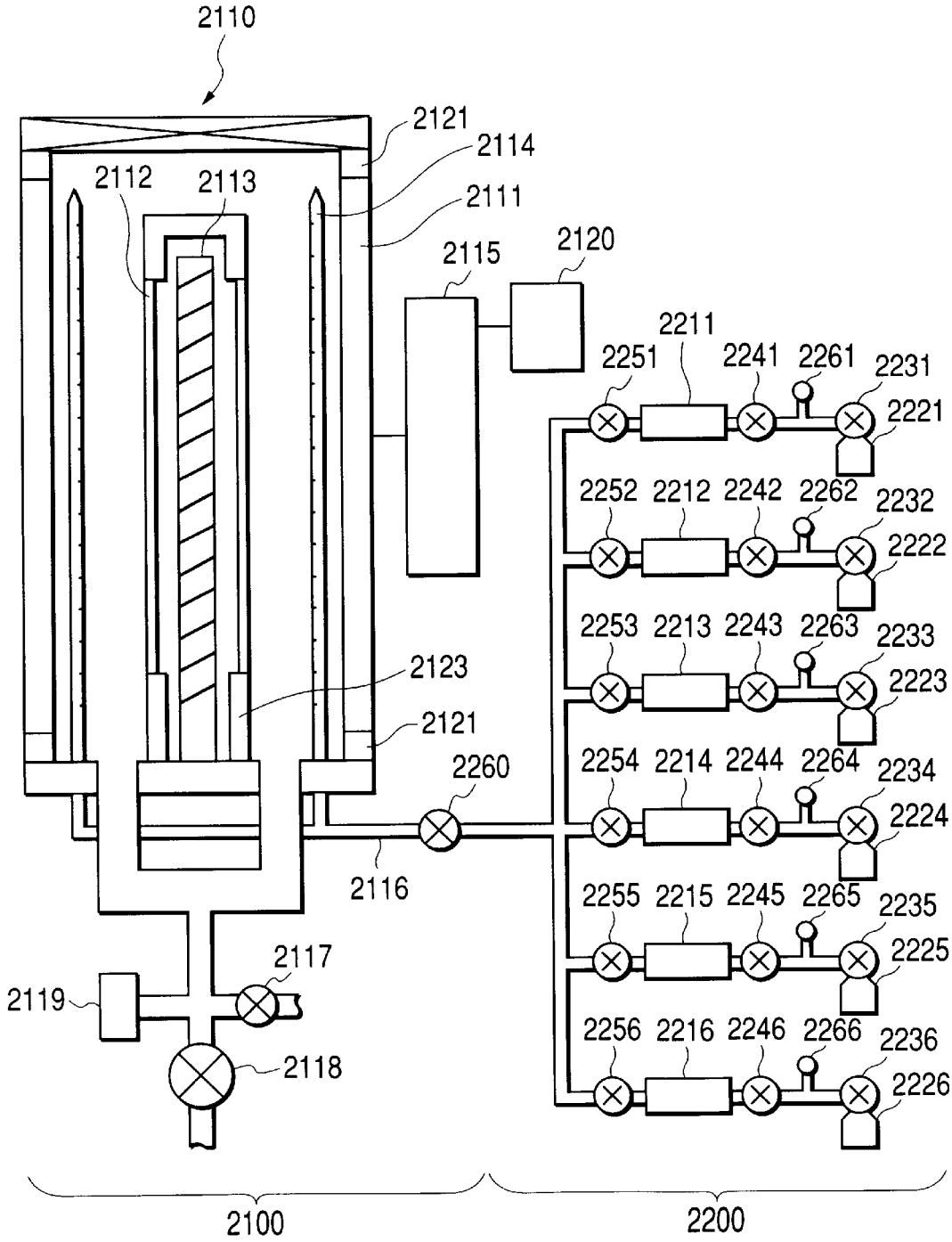
FIG. 2 is a schematic sectional view of an a-Si photosensitive member film formation system used in the present invention.

FIG. 2 diagrammatically illustrates an example of a deposition apparatus for producing the photosensitive member by RF plasma-assisted CVD making use of a high-frequency power source.

This apparatus is constituted chiefly of a deposition system 2100, a material gas feed system 2200 and an exhaust system (not shown) for evacuating the inside of a deposition chamber 2110. In the deposition chamber 2110 in the deposition system 2100, a cylindrical substrate 2112, a heater 2113 for heating the substrate, and a material gas feed pipe 2114 are provided. A high-frequency power source 2120 is further connected to the deposition chamber via a high-frequency matching box 2115.

The material gas feed system 2200 is constituted of gas cylinders 2221 to 2226 for material gases such as $SiH_4$, $H_2$, $CH_4$, NO, $B_2H_6$ and $CF_4$, valves 2231 to 2236, 2241 to 2246 and 2251 to 2256, and mass flow controllers 2211 to 2216. The gas cylinders for the respective constituent gases are connected to the gas feed pipe 2114 in the deposition chamber 2110 via a valve 2260.

The cylindrical substrate 2112 is set on a conductive supporting stand 2123 and is thereby connected to the ground.

An example of procedure of forming a photosensitive member by means of the apparatus shown in FIG. 2 is described below.

The cylindrical substrate 2112 is set in the deposition chamber 2110, and the inside of the deposition chamber is evacuated by means of an exhaust device (e.g., a vacuum pump; not shown). Subsequently, the temperature of the cylindrical substrate 2112 is controlled at a desired temperature of, e.g., from 200° C. to 450° C., preferably from 250° C. to 350° C., by means of the heater 2113 for heating the substrate. Next, before material gases for forming the photosensitive member are flowed into the deposition chamber 2110, gas cylinder valves 2231 to 2236 and a leak valve 2117 of the deposition chamber are checked to make sure that they are closed, and also flow-in valves 2241 to 2246, flow-out valves 2251 to 2256 and an auxiliary valve 2260 are checked to make sure that they are opened. Then, a main valve 2118 is opened to evacuate the insides of the deposition chamber 2110 and a gas feed pipe 2116.

Thereafter, at the time a vacuum gauge 2119 has been read to indicate a pressure of about 0.67 mpa, the auxiliary valve 2260 and the flow-out valves 2251 to 2256 are closed. Thereafter, valves 2231 to 2236 are opened so that gases are respectively introduced from gas cylinders 2221 to 2226, and each gas is controlled to have a pressure of 0.2 MPa by operating pressure controllers 2261 to 2266. Next, the flow-in valves 2241 to 2246 are slowly opened so that gases are respectively introduced into mass flow controllers 2211 to 2216.

After the film formation has been made ready to start as a result of the above procedure, the photoconductive layer is first formed on the cylindrical substrate 2112.

That is, at the time the cylindrical substrate 2112 has had the desired temperature, some necessary flow-out valves 2251 to 2256 and the auxiliary valve 2260 are slowly opened so that desired gases are fed into the deposition chamber 2110 from the gas cylinders 2221 to 2226 through a gas feed pipe 2114. Next, the mass flow controllers 2211 to 2216 are operated so that each material gas is adjusted to flow at a desired rate. In that course, the opening of the main valve 2118 is adjusted while watching the vacuum gauge 2119 so that the pressure inside the deposition chamber 2110 comes to a desired pressure of from 13.3 Pa to 1,330 Pa. At the time the inner pressure has become stable, a high-frequency power source 2120 is set at a desired electric power and a high-frequency power with a frequency of from 1 MHz to 50 MHz, in particular, 13.56 MHz is supplied to a cathode electrode 2111 through the high-frequency matching box 2115 to cause high-frequency glow discharge to take place. The material gases fed into the deposition chamber 2110 are decomposed by the discharge energy thus produced, so that the desired photoconductive layer composed chiefly of silicon atoms is formed on the cylindrical support 2112. After a film with a desired thickness has been formed, the supply of RF power is stopped, and the flow-out valves 2251 to 2256 are closed to stop gases from flowing into the deposition chamber 2110. The formation of the photoconductive layer is thus completed.

Where the intended photoconductive layer 106 has a multi-layer construction, the like operation may be repeated plural times, whereby the desired multi-layer structure can be formed. Namely, e.g., an a-Si photoconductive layer may be formed which is of multi-layer construction having the desired properties and layer thickness for each layer successively deposited on the surface of the cylindrical substrate film.

In the case when the intermediate layer 105 is provided on the photoconductive layer 106 as in the construction shown in FIG. 1, it may be formed in the following way: for example, when a series of a-Si deposited films are formed according to the procedure described above and the formation of the last one layer a-Si deposited film is completed, i) without stopping the supply of high-frequency power and also without stopping the feeding of materials gases, deposition conditions are continuously changed to the conditions for supplying high-frequency power, gas composition and conditions of gas feed flow rates for the intermediate layer 105, or ii) the supply of high-frequency power is once stopped, but, under conditions of high-frequency power supply which are set newly, the feeding of materials gases is started from feed conditions used in the previous layer deposition, and the gas composition and flow rates are continuously changed therefrom to the feed conditions which provide the desired construction of the intermediate layer 105. Thus, a region with compositional change can be formed at the interface between the intermediate layer 105 and the photoconductive layer 106. This enables the light to be kept from reflecting at that interface.

The cylindrical substrate on which films have been formed up to the photoconductive layer in the manner described above is once taken out of the deposition chamber and is left to cool naturally. In that course, the deposition chamber can be used for the next photosensitive member film formation. Also, in the present invention, in the course of this natural cooling, the external appearance may be inspected to check any peeling or spherical protrusions. Also, in the case of the photosensitive member provided with the intermediate layer so far, image inspection and potential characteristics inspection may also be made.

Where the photoconductive layer has come into contact with ozone in the inspection, e.g., in such image inspection and potential characteristics, it is preferable to wash its surface with water or wash it with organic matter before the surface layer is formed. In consideration of environment in recent years, washing with water is preferred. Methods for the washing with water are described later. The washing with water thus carried out before the surface layer is formed can more improve the adherence of the surface layer.

The unfinished photosensitive member the substrate temperature of which has lowered to about room temperature as a result of the natural cooling is returned to and again set in the deposition chamber, and then the surface layer is formed. Here, the surface may previously gently be etched with a fluorine type gas such as $CF_4$, $C_2F_6$ or $F_2$; or $H_2$ gas to remove any stains adhering to the surface. This is preferable because the adherence of the surface layer can be more improved.

The film formation of the surface layer may basically be conducted according to the film formation of the photoconductive layer except that a hydrocarbon gas such as $CH_4$ or $C_2H_6$ and optionally a dilute gas such as $H_2$ are used. In the case of the a-C surface layer, the substrate temperature is set at about room temperature, and hence the substrate is not heated. In the case when the intermediate layer is formed beneath the surface layer, the desired gases may be fed before the surface layer is formed, and basically the above operation may be repeated.

Thus, the photosensitive member of the present invention is produced.

Figure 3:
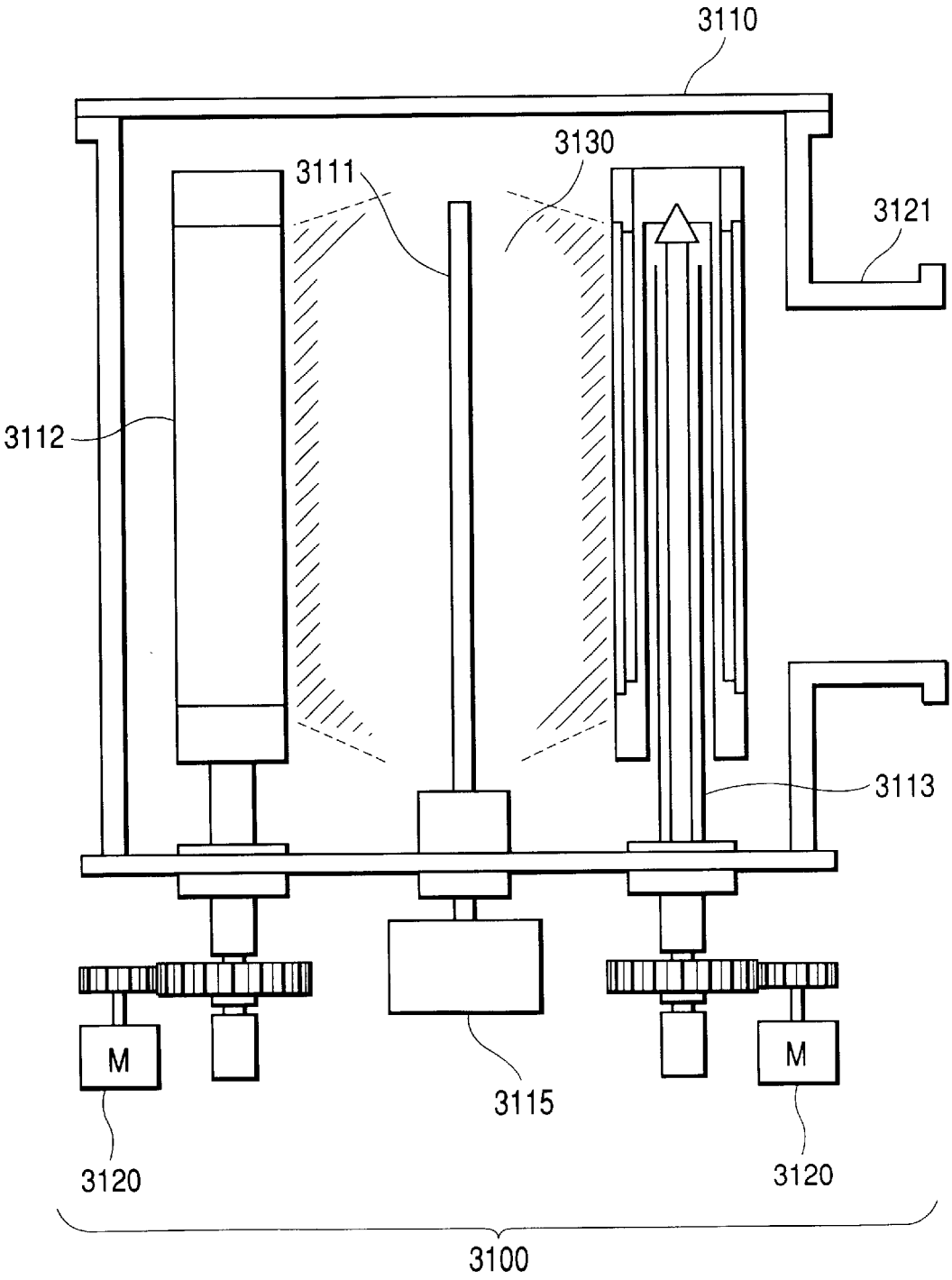
FIG. 3 is a schematic sectional view of another a-Si photosensitive member film formation system used in the present invention.

FIG. 3 diagrammatically illustrates an example of a deposition apparatus for producing the photosensitive member by VHF plasma-assisted CVD making use of a VHF power source.

This apparatus is constructed by replacing the deposition system 2100 shown in FIG. 2, with a deposition system 3100 shown in FIG. 3.

The formation of deposited films in this apparatus by the VHF plasma-assisted CVD can be carried out basically in the same manner as the case of RF plasma-assisted CVD. Here, the high-frequency power to be applied is supplied from a VHF power source with a frequency of from 50 MHz to 450 MHz, e.g., a frequency of 105 MHz. The pressure is kept at approximately from 13.3 mPa to 1,330 Pa, i.e., a pressure a little lower than that in the RF plasma-assisted CVD. In this apparatus, in a discharge space 3130 surrounded by cylindrical substrates 3112, the material gas fed thereinto is excited by discharge energy to undergo dissociation, and a stated deposited film is formed on each cylindrical substrate 3112. Here, the cylindrical substrate is rotated at a desired rotational speed by means of a substrate drive unit 3120 so that the layer can uniformly be formed.

Figure 11:
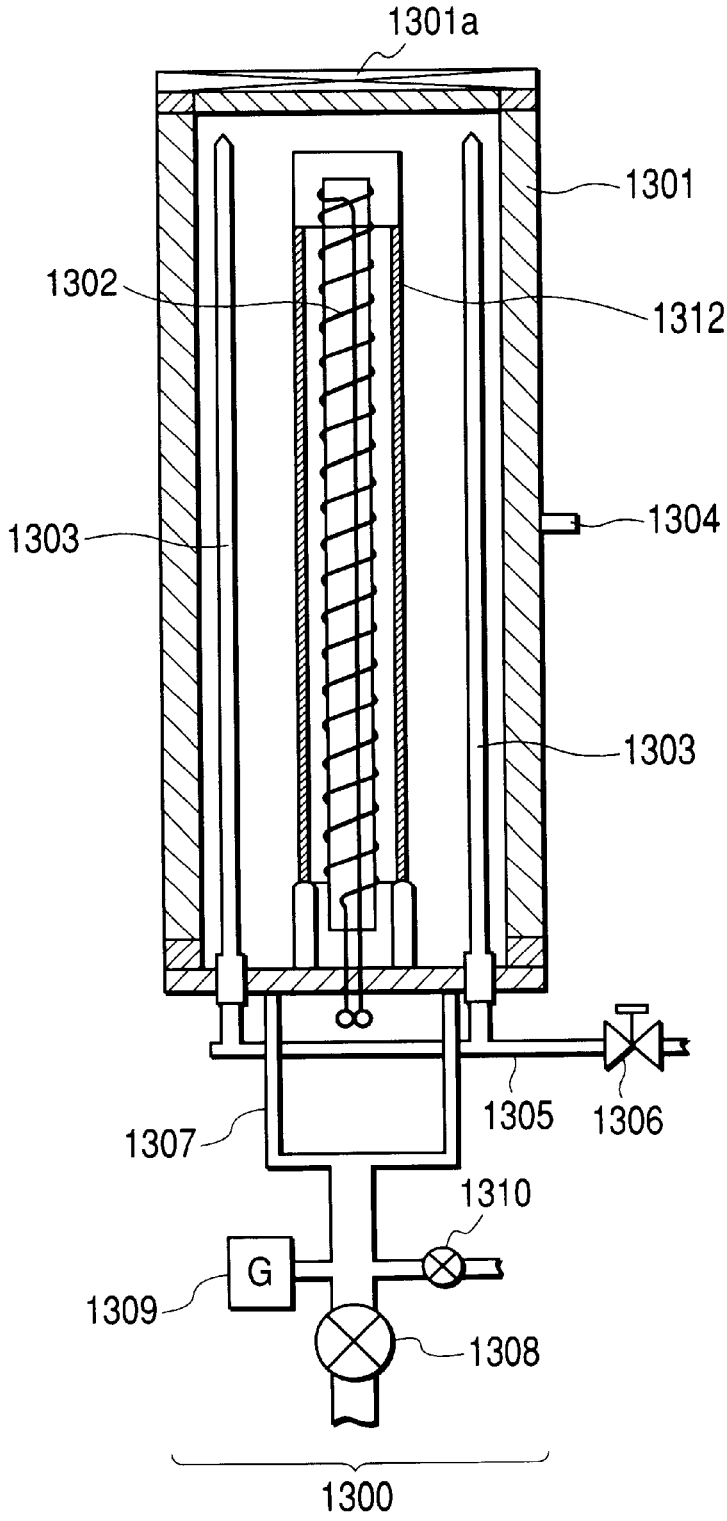
FIG. 11 is a schematic sectional view of an a-Si photosensitive member film formation system used in the present invention.

FIG. 11 shows an example of a PCVD (plasma-assisted CVD) usable in the production of the electrophotographic photosensitive member according to the present invention. The apparatus shown in FIG. 11 is a PCVD apparatus having common construction used in the production of electrophotographic photosensitive members. This PCVD apparatus is constituted of a deposition system 1300 shown in FIG. 11, and a material gas feed system and an exhaust system (both not shown).

The deposited-film formation system 1300 has a deposition chamber 1301 which is a vertical vacuum tube. In this deposition chamber 1301, a plurality of gas-introducing pipes 1303 extending in the vertical direction are provided around a cylindrical substrate 1312, and a large number of minute holes are made in the sidewalls of the gas-introducing pipes 1303 along its lengthwise direction. At the center of the deposition chamber 1301, a spirally coiled heater 1302 is provided extendingly in the vertical direction. The cylindrical substrate 1312 serving as the substrate of the photosensitive member is inserted into the deposition chamber 1301 after its top cover 1301*a* is opened, and is installed in the deposition chamber 1301 with the heater 1302 inside. Also, a high-frequency power is supplied through a supply terminal 1304 provided on one side of the deposition chamber 1301.

To the bottom of the deposition chamber 1301, a material gas feed line 1305 connected to the gas-introducing pipes 1303 is attached, and this feed line 1305 is connected to the material gas feed system (not shown) via a feed valve 1306. An exhaust tube 1307 is also attached to the bottom of the deposition chamber 1301. This exhaust tube 1307 is connected to an exhaust unit (e.g., vacuum pump; not shown) via a main exhaust valve 1308. To the exhaust valve 1307, a vacuum gauge 1309 and an exhaust sub-valve 1310 are further attached.

To form the a-Si photosensitive layer by PCVD using the above PCVD system, it may be formed, e.g., in the following way. First, the cylindrical substrate 1312 serving as the substrate of the photosensitive member is set in the deposition chamber 1301, and the top cover 1301*a* is closed. Thereafter, the inside of the deposition chamber 1301 is evacuated to a pressure of a stated pressure or below by means of the exhaust unit (not shown). Next, continuing the evacuation, the cylindrical substrate 1312 is heated from the inside by means of the heater 1302 to control the surface temperature of the cylindrical substrate 1312 to a stated temperature selected within the range of from 20° C. to 450° C. At the time the surface temperature of the cylindrical substrate 1312 has reached the stated temperature and has become stable, the desired material gases are fed into the deposition chamber 1301 though the gas-introducing pipes 1303 while the gases are controlled to stated flow rates by means of their corresponding flow-rate control assemblies (not shown). The material gases thus fed are, after the inside of the deposition chamber 1301 has been filled with them, driven off outside the deposition chamber 1301 through the exhaust tube 1307.

The exhaust rate is regulated, and the vacuum gauge 1309 is checked to make sure that the inside of the deposition chamber 1301 thus filled with the material gases being fed has reached a stated pressure and has become stable. At this stage, a high-frequency power is supplied into the deposition chamber 1301 at a desired input power level from a high-frequency power source (not shown; RF band of 13.56 MHz, or VHF band of from 50 MHz to 150 MHz) to cause glow discharge to take place in the deposition chamber 1301. Components of the material gases are decomposed by the energy of this glow discharge, so that the a-Si deposited film composed chiefly of silicon atoms is formed on the surface of the cylindrical substrate 1312. Here, parameters of gas species, gas feed quantity, gas feed ratio, deposition chamber internal pressure, substrate surface temperature, input power level and so forth may be regulated to form a-Si deposited films having various characteristics. Such deposition conditions and layer thickness of deposited films may appropriately be selected, whereby electrophotographic performances of the photosensitive member having the resultant a-Si deposited film as the photoconductive layer can be controlled.

At the time the a-Si deposited film has been thus formed on the surface of the cylindrical substrate 1312 in the desired layer thickness, the supply of the high-frequency power is stopped, and the feed valve 1306 and so forth are closed to stop material gases from being fed into the deposition chamber 1301, thus the formation of the a-Si deposited film is completed for one layer. Where the intended a-Si deposited film has a multi-layer construction, the like operation may be repeated plural times, whereby the desired multi-layer structure can be formed. Namely, e.g., an a-Si photoconductive layer may be formed which is of multi-layer construction having the desired properties and layer thickness for each layer successively deposited on the surface of the cylindrical substrate film.

In the case when the intermediate layer 605 is provided on the photoconductive layer 602 as in the construction shown in FIGS. 6A to 6C, it may be formed in the following way: for example, when a series of a-Si deposited films are formed according to the procedure described above and the formation of the last one layer a-Si deposited film is completed, i) without stopping the supply of high-frequency power and also without stopping the feeding of materials gases, deposition conditions are continuously changed to the conditions for supplying high-frequency power, gas composition and conditions of gas feed flow rates for the intermediate layer 605, or ii) the supply of high-frequency power is once stopped, but, under conditions of high-frequency power supply which are set newly, the feeding of materials gases is started from feed conditions used in the previous layer deposition, and the gas composition and flow rates are continuously changed therefrom to the feed conditions which provide the desired construction of the intermediate layer 605. Thus, a region with compositional change can be formed at the interface between the intermediate layer 605 and the photoconductive layer 602. This enables the light to be kept from reflecting at that interface.

Also when the a-C:H surface protective layer is formed in the electrophotographic photosensitive member of the present invention after the surface processing, the PCVD apparatus having the construction shown in FIG. 11 is used. The inside of the deposition chamber 1301 is once evacuated to a high vacuum, and thereafter the stated material gas, e.g., the hydrocarbon gas such as $CH_4$, $C_2H_6$, $C_3H_8$ or $C_4H_{10}$ and optionally the material gas such as hydrogen gas, helium gas or argon gas, having been mixed by a mixing panel (not shown), are fed into the deposition chamber 1301 through the material gas feed pipe 1305. Also, the flow rates of the respective material gases are adjusted by means of the mass flow controllers (not shown) so as to come to the desired flow rates. Meanwhile, the exhaust rate is so regulated that the internal pressure of the deposition chamber 1301 comes to a stated pressure selected at 133.3 Pa or below, monitoring the internal pressure on the vacuum gauge 1309. After making sure that the internal pressure of the deposition chamber 1301 has become stable, a high-frequency power set at a desired feed power level is supplied from a high-frequency power source (not shown) to the inside of the deposition chamber 1301 through the supply terminal 1304 to cause high-frequency glow discharge to take place. Here, a high-frequency matching box (not shown) is so adjusted that any reflection wave comes minimum, thus the value found by subtracting reflected power from inputted power of the high-frequency power (i.e., the effective feed power level) is adjusted to the desired value. The material gases such as hydrocarbon gas fed into the deposition chamber 1301 are decomposed by the discharge energy of the high-frequency power, so that the stated a-C:H deposited film is formed on the photoconductive layer 102 or intermediate layer 105. After the film with the desired thickness has been formed, the supply of the high-frequency power is stopped, and the material gases are stopped from being fed into the deposition chamber 1301, where the inside of the deposition chamber 1301 is evacuated to a high vacuum, thus the formation of the surface protective layer is completed.

In the deposited-film formation step described above, i) the flow rate distribution in the lengthwise direction of the gas-introducing pipes 1303 in respect of the material gases fed into the deposition chamber 1301 through the minute holes distributed in the lengthwise direction of the gas-introducing pipes 1303, ii) the rate of flow-out (exhaust rate) of exhaust gas from the exhaust tube, iii) the discharge energy and so forth may be regulated so that the distribution of composition and so forth of the a-Si deposited film in its lengthwise direction of the cylindrical substrate 1312 may uniformly be controlled. Thus, the uniformity of electrophotographic performance of the photosensitive member to be obtained can be controlled.

Where the etching is carried out before the a-C:H deposited film is formed, a stated etching gas, commonly a fluorine-containing gas or hydrogen gas, may be fed in place of the materials gases used for film formation and a high-frequency power may be supplied to raise plasma discharge to effect etching.

(Water Washing System According to the Present Invention)

With regard to the washing with water, it is disclosed in, e.g., Japanese Patent No. 2786756 (corresponding to U.S. Pat. No. 5,314,780). An example of the water washing system (washer) according to the present invention is shown in FIG. 4.

Figure 4:
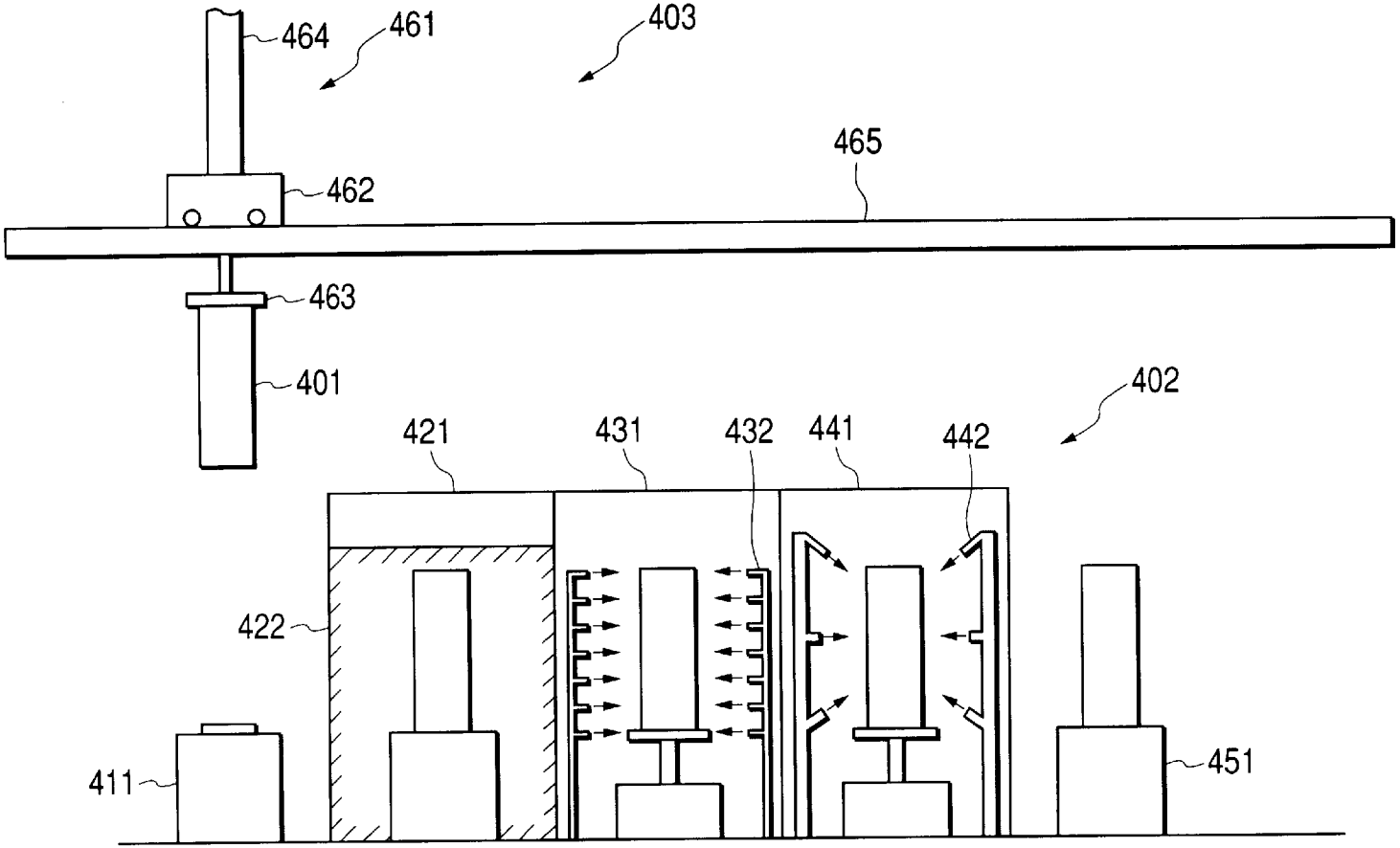
FIG. 4 is a schematic sectional view of a water washing system used in the present invention.

The washing system shown in FIG. 4 consists of a treating section 402 and a treating object member (member to be treated) transport mechanism 403. The treating section 402 consists of a treating object member feed stand 411, a treating object member wash chamber 421, a pure-water contact chamber 431, a drying chamber 441 and a treating object member delivery stand 451. The wash chamber 421 and the pure-water contact chamber 431 are both fitted with temperature control units (not shown) for keeping the liquid temperature constant. The transport mechanism 403 consists of a transport rail 465 and a transport arm 461, and the transport arm 461 consists of a moving mechanism 462 which moves on the rail 465, a chucking mechanism 463 which holds a substrate 401 having a conductive surface, and an air cylinder 464 for up and down moving the chucking mechanism 463. The treating object member 401 placed on the feed stand 411 is transported to the wash chamber 421 by means of the transport mechanism 403. Any oil and powder adhering to the surface are washed away in the wash chamber 421 by ultrasonic treatment made in a wash liquid 422 comprised of an aqueous surface-active agent solution. Next, the treating object member 401 is carried to the pure-water contact chamber 431 by means of the transport mechanism 403, where pure water with a resistivity of 175 kΩ·m (17.5 MΩ·cm), kept at a temperature of 25° C., is sprayed against it from a nozzle 432 at a pressure of 4.9 MPa (50 kgf/cm$^2$). The treating object member 401 on which the step of pure-water contact has been finished is moved to the drying chamber 441 by means of the transport mechanism 403, where high-temperature high-pressure air is blown against it from a nozzle 442, so that the treating object member is dried. The treating object member 401 on which the step of drying has been finished is carried to the delivery stand 451 by means of the transport mechanism 403.

(Electrophotographic Apparatus According to the Present Invention)

Figure 5:
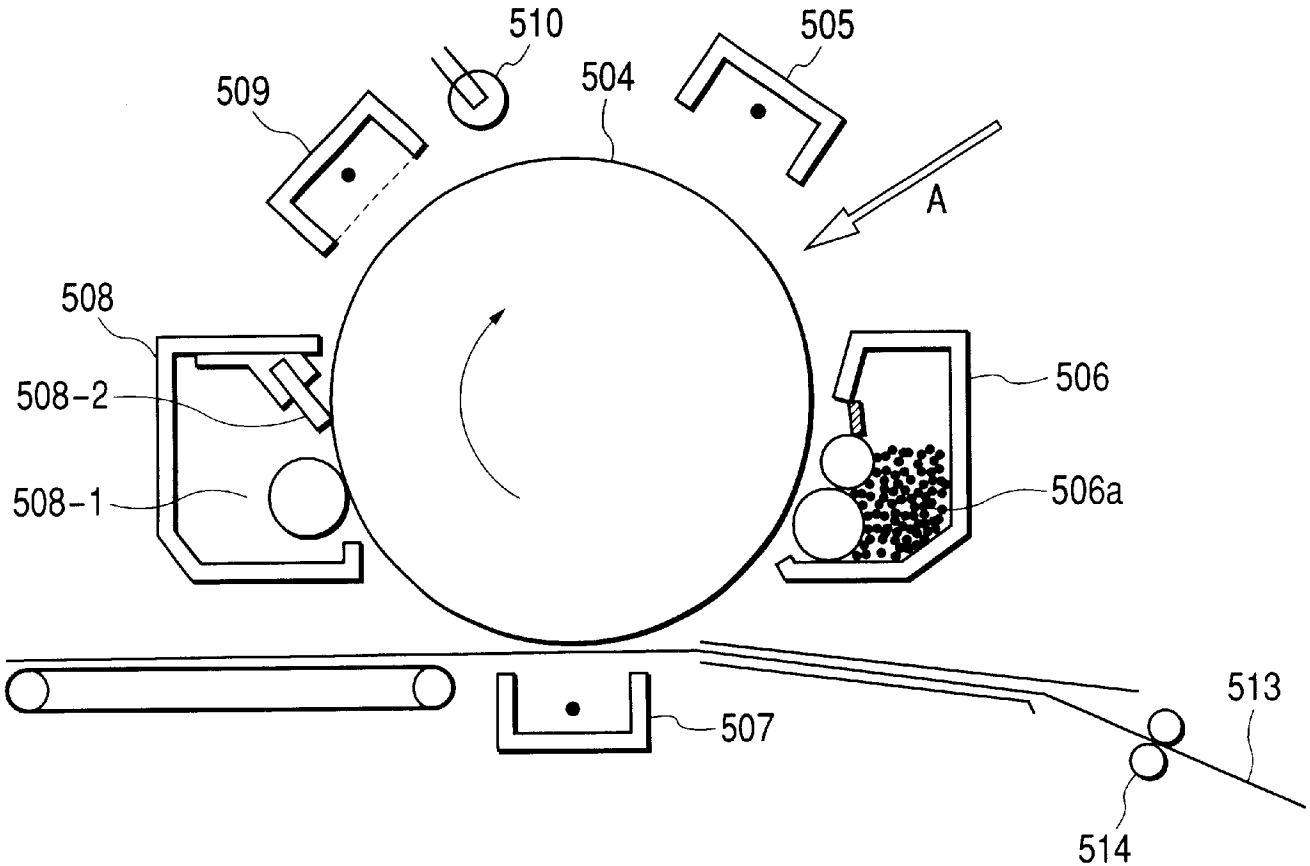
FIG. 5 is a diagrammatic sectional view of an example of the electrophotographic apparatus of the present invention.

An example of an electrophotographic apparatus making use of the electrophotographic photosensitive member of the present invention is shown in FIG. 5. The apparatus of this example is suited when a cylindrical electrophotographic photosensitive member is used. The electrophotographic photosensitive member of the present invention is by no means limited to this example, and the photosensitive member may have any desired shape such as the shape of an endless belt.

In FIG. 5, reference numeral 504 denotes the electrophotographic photosensitive member which is referred to in the present invention; and 505, a primary charging assembly which performs charging in order to form an electrostatic latent image on the photosensitive member 504. In FIG. 5, a corona charging assembly is illustrated. The charging assembly, however, may be a contact charging assembly as disclosed in Japanese Patent Application Laid-Open No. 63-210864. Reference numeral 506 denotes a developing assembly for feeding a developer (toner) 506*a* to the photosensitive member 504 on which the electrostatic latent image has been formed; and 507, a transfer charging assembly for transferring the toner on the photosensitive member surface to a transfer medium. In FIG. 5, a corona charging assembly is illustrated. The transfer charging assembly, however, may be a roller electrode as disclosed in Japanese Patent Application Laid-Open No. 62-175781. Reference numeral 508 denotes a cleaner with which the photosensitive member surface is cleaned. In this example, in order to perform uniform cleaning of the photosensitive member surface effectively, the photosensitive member is cleaned by means of an elastic roller 508-1 and a cleaning blade 508-2. However, other construction may also be designed in which only any one of them is provided or the cleaner 508 itself is not provided. Reference numerals 509 and 510 denote an AC charge eliminator and a charge elimination lamp, respectively, for eliminating electric charges from the photosensitive member surface so as to be prepared for the next-round copying operation. Of course, other construction may also be designed in which any one of them is not provided or the both are not provided. Reference numeral 513 denotes a transfer medium such as paper; and 514, a transfer medium feed roller. As a light source of exposure A, a halogen light source or a light source such as a laser or LED chiefly of single wavelength is used.

Using such an apparatus, copied images are formed, e.g., in the following way.

First, the electrophotographic photosensitive member 504 is rotated in the direction of an arrow at a stated speed, and the surface of the photosensitive member 504 is uniformly electrostatically charged by means of the primary charging assembly 505. Next, the surface of the photosensitive member 504 thus charged is subjected to exposure A for an image to form an electrostatic latent image of the image on the surface of the photosensitive member 504. Then, when the surface of the photosensitive member 504 at its part where the electrostatic latent image has been formed passes the part provided with the developing assembly 506, the toner is fed to the surface of the photosensitive member 504 by means of the developing assembly 506, and the electrostatic latent image is rendered visible (developed) as an image formed of the toner 506*a* (toner image). As the photosensitive member 504 is further rotated, this toner image reaches the part provided with the transfer charging assembly 507, where it is transferred to the transfer medium 513 forwarded by means of the feed roller 514.

After the transfer has been completed, to make preparation for the next copying step, the surface of the photosensitive member 504 is cleaned to remove residual toner therefrom by means of the cleaner 508, and is further subjected to charge elimination by means of the charge eliminator 509 and charge elimination lamp 510 so as to make the potential of that surface zero or almost zero. Thus, first-time copying step is completed.

Figure 6A:
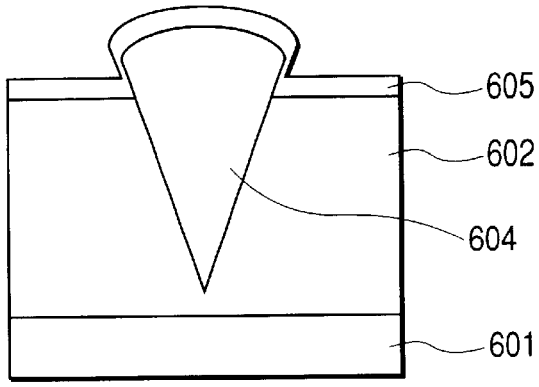
FIGS. 6A, 6B and 6C are sectional views diagrammatically showing an example of the construction of the electrophotographic photosensitive member according to the present invention, in particular, its structure of the protrusions occurring at the time of deposition.
Figure 6B:
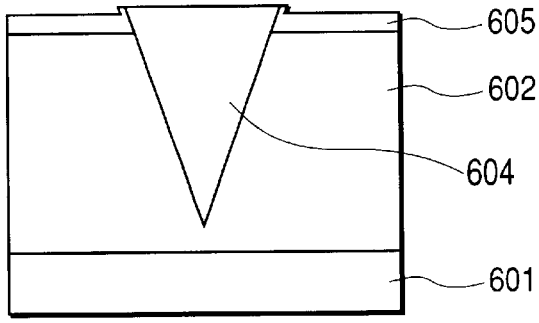
Figure 6C:
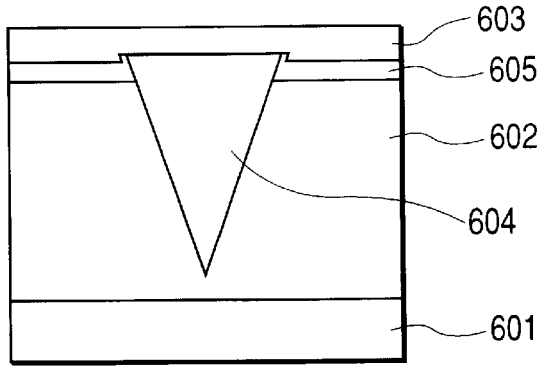

FIGS. 6A to 6C diagrammatically show an example of the construction of the electrophotographic photosensitive member according to the present invention, in particular, its structure of the protrusions occurring at the time of deposition.

In the example of construction shown in FIGS. 6A to 6C, the electrophotographic photosensitive member has a multilayer structure in which, on a cylindrical substrate 601 formed of, e.g., a conductive material such as aluminum or stainless steel, a photoconductive layer 602 formed in the first step and a surface protective layer 603 formed in the third step are deposited in order. In addition to these essential constituents two layers, i.e., the photoconductive layer 602 and the surface protective layer 603, the electrophotographic photosensitive member of the present invention may optionally be provided with various functional layers such as an intermediate layer 605 which is provided between the photoconductive layer 602 and the surface protective layer 603 and a charge injection blocking layer (not shown) which is provided between the substrate 601 and the photoconductive layer 602. In the example of construction shown in FIGS. 6A to 6C, the intermediate layer 605 is provided, and, e.g., in the first step, the intermediate layer 605 is deposited subsequent to the formation of the photoconductive layer 602. Also, a protrusion 604 is the protrusion specific to a-Si photosensitive members which occurs arising from nuclei grown extrinsically in the step of forming the photoconductive layer 602.

FIG. 6A is a diagrammatic sectional view of the protrusion at a stage where the intermediate layer 105 has been formed subsequent to the photoconductive layer 602. The material of the protrusion 604 is substantially the same as that of the surrounding photoconductive layer 602. The intermediate layer 605 stands so formed as to extend after the shape of the protrusion on the surfaces of the photoconductive layer 602 and the protrusion 604. FIG. 6B diagrammatically shows a state where the deposited film having been formed as the intermediate layer 605 has been subjected to surface processing, i.e., polishing in this example, to remove the vertex of the protrusion 604, protruding from the surface, to make the surface flat.

FIG. 6C shows a state where the surface protective layer 603 has been formed on the surface standing as shown in FIG. 6B, having been subjected to the surface processing. As shown in this example, the surface protective layer deposited on the surface having been subjected to the surface processing to flatten the surface is in a state where it covers the whole surface uniformly, and, at the outermost surface, the a-C:H film is formed in substantially the same thickness at every part.

In the second step, when the film is subjected to surface processing, e.g., polishing, it is also preferable to carry out the surface processing in an environment which does not cause any oxidation, as in vacuum, in order to keep any surface oxidation from occurring after the processing. However, usually the oxidation that may accompany the surface processing has little influence. Suppose a surface processing means is used which must wary about any influence of oxidation, the processed surface may thereafter be washed before the surface protective layer 603 is formed. Alternatively, immediately before its formation, the surface may be subjected to etching. Thus, any influence of oxidation can greatly be lessened. Accordingly, it is less necessary for the surface processing to be carried out in vacuum, and is possible for it to be done in the atmosphere. Also, from the viewpoint of an advantage that various surface processing means can be used, it is rather preferable for it to be done in the atmosphere.

The surface processing is done in order to remove the vertexes of the protrusions 604, protruding from the surface, to make the surface flat, and a polishing means is a preferable means. However, an etching means may also be used which can selectively remove the protrusions. Compared with normal areas, such protrusions are those which have been formed as a result of any local difference in deposition rate, and hence, in a sense, are structurally different in nature. Utilizing such difference, etching conditions may be selected so that conditions can be set under which the etching rate may selectively be high at the part of protrusions. According to such structurally selective etching conditions, the vertexes of the protrusions 604, protruding from the surface, may be removed to flatten the surface by setting conditions under which only the part of protrusions is speedily etched away and on the other hand the etching may proceed only slightly at the part of normal areas.

(Surface-polishing Apparatus Used in the Production Process for the Electrophotographic Photosensitive Member of the Present Invention)

Figure 7:
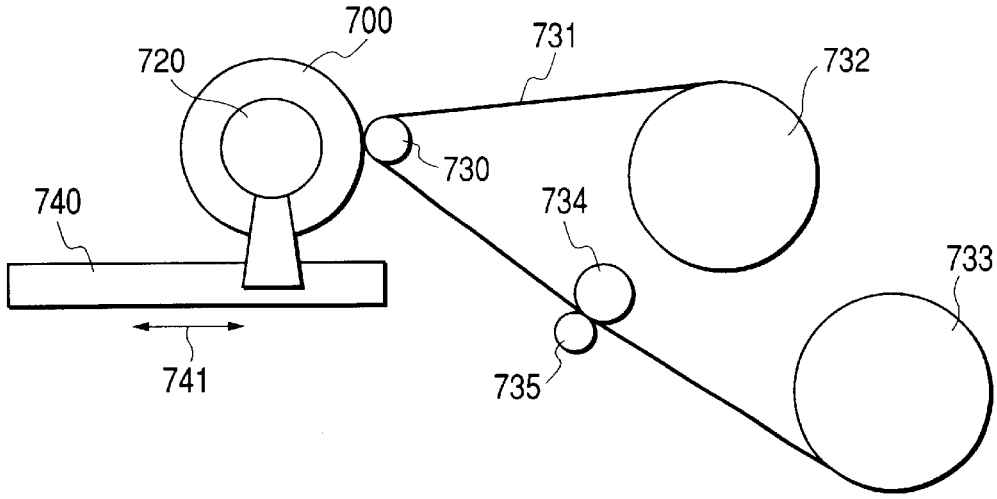
FIG. 7 is a schematic sectional view showing an example of a surface-polishing apparatus used in surface processing, in the steps of producing the electrophotographic photosensitive member according to the present invention.

FIG. 7 shows an example of a surface-polishing apparatus used in the production process for the electrophotographic photosensitive member of the present invention when the surface processing is carried out, stated specifically, an example of a surface-polishing apparatus used when polishing is carried out as the surface processing.

In the example of construction of the surface-polishing apparatus shown in FIG. 7, an object member to be processed, or a processing object member (the surface of the deposited film on the cylindrical substrate) 700 is the cylindrical substrate on the surface of which the a-Si photoconductive layer and optionally the intermediate layer has or have been deposited, and is attached to an elastic support mechanism 720. In the apparatus shown in FIG. 7, for example an air pressure holder is used as the elastic support mechanism 720. Stated specifically, an air pressure holder manufactured by Bridgestone Corporation (trade name: AIR PICK; model: PO45TCA*820) is used. A pressure elastic roller 730 is pressed against the surface of the a-Si photoconductive layer or intermediate layer of the processing object member 700 via a polishing tape 731 put around the roller. The polishing tape 731 is delivered from a wind-off roll 732 and wound up on a wind-up roll 733. Its delivery speed is regulated by a constant-rate delivery roll 734 and a capstan roller 735, and its tension is also regulated by them. As the polishing tape 731, a tape usually called a lapping tape may preferably be used. When the a-Si photoconductive layer or intermediate layer is subjected to surface processing, a lapping tape may be used in which SiC, $Al_2O_3$, $Fe_2O_3$ or the like is used as abrasive grains. Stated specifically, a lapping tape LT-C2000, available from Fuji Photo Film Co., Ltd, is used.

The pressure elastic roller 730 has its roller part made of a material such as neoprene rubber or silicone rubber, and has a JIS rubber hardness in the range of from 20 to 80, and preferably a JIS rubber hardness in the range of from 30 to 40. The roller part may also preferably have such a shape that it has a diameter which is larger at the middle portion than that at both ends, preferably having, e.g., a diameter difference between them in the range of from 0.0 to 0.6 mm, and more preferably in the range from 0.2 to 0.4 mm. The pressure elastic roller 730 is pressed against the processing object member (the surface of the deposited film on the cylindrical substrate) 700 being rotated, at a pressure in the range of from 0.5 kg load/$cm^2$ to 2.0 kg load/$cm^2$, during which the lapping tape 731, e.g., the above lapping tape is fed between them to polish the deposited-film surface.

Where the surface polishing is carried out in the atmosphere, a means of wet polishing such as buffing may also be used besides the above means making use of the polishing tape. Also, when this means of wet polishing is used, the step of removing by washing a liquid used for polishing may be provided after the polishing step. In such a case, treatment in which the surface is brought into contact with water to wash the surface may also be made in combination.

(Vacuum Surface-polishing Apparatus Used in the Production Process for the Electrophotographic Photosensitive Member of the Present Invention)

Figure 8:
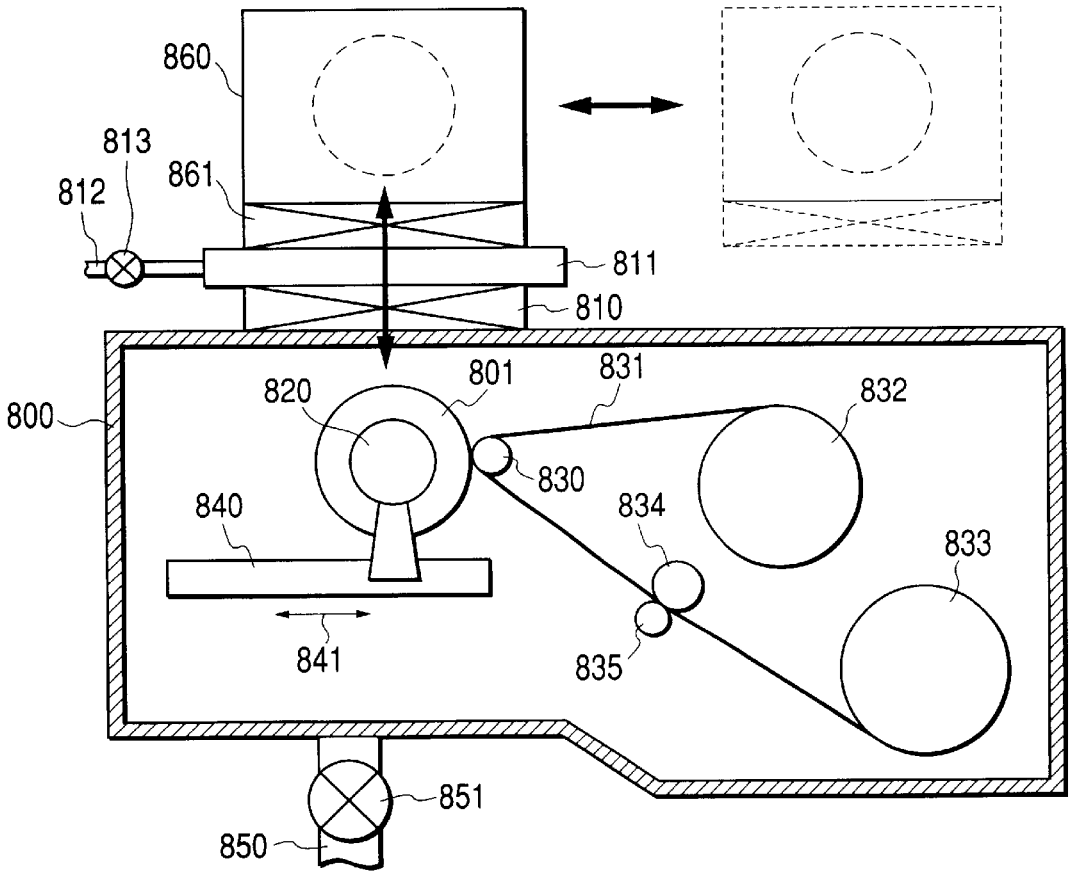
FIG. 8 is a schematic sectional view showing an example of a vacuum surface-polishing apparatus used in surface processing, in the steps of producing the electrophotographic photosensitive member according to the present invention.

FIG. 8 shows an example of a surface-polishing apparatus used in the production process for the electrophotographic photosensitive member of the present invention when the surface processing is carried out, stated specifically, an example of a vacuum surface-polishing apparatus used when polishing is carried out as the surface processing.

The vacuum surface-polishing apparatus shown in FIG. 8 has substantially the same construction as the FIG. 7 surface-polishing apparatus in respect of its polishing section itself, except that, in order to carry out the polishing in vacuum, the polishing section is held in a vacuum container 800 and a transport mechanism is added with which a processing object member 801 can be transported in vacuum.

In FIG. 8, the vacuum container 800 can be evacuated by means of an evacuation system (not shown) connected to an exhaust tube 850 provided with an exhaust valve 851. The vacuum container 800 is also provided with a gate valve 810 at an opening through which the processing object member 801 is brought into and out, and is further provided with a transport mechanism joint 811 having an exhaust tube 812 provided with an exhaust valve 813; the joint being connected to the gate valve 810.

The processing object member 801 (the surface of the deposited film on the cylindrical substrate) on which the a-Si photoconductive layer and optionally the intermediate layer has or have been formed in the deposited-film formation apparatus is, in the state of being kept vacuum, once introduced from the deposited-film formation apparatus into a transport container 860 having a gate valve 861. The whole of this transport container 860 kept vacuum is moved and transported from the deposited-film formation apparatus to the part of the vacuum polishing apparatus. The gate valve 861 is joined to the transport mechanism joint 811, and then the inside of the transport mechanism joint 811 is evacuated to a stated degree of vacuum (pressure) by means of an evacuation system (not shown) connected to the exhaust tube 812. Thereafter, the gate valves 810 and 861 are opened to move the processing object member 801 (the surface of the deposited film on the cylindrical substrate) from the transport container 860 to the polishing section inside the vacuum container 800, and set it therein. Stated specifically, the processing object member 801 is moved to the vicinity of setting position shown in FIG. 8, and then held with an air pressure holder 820.

The processing object member 801 is held with an elastic support mechanism 820 as exemplified by the air pressure holder 820, stated specifically, with an air pressure holder manufactured by Bridgestone Corporation (trade name: AIR PICK; model: PO45TCA*820) is used. A pressure elastic roller 830 is pressed against the surface of the a-Si photoconductive layer or intermediate layer of the processing object member 800 via a polishing tape 831 put around the roller. The polishing tape 831 is delivered from a wind-off roll 832 and wound up on a wind-up roll 833. Its delivery speed is regulated by a constant-rate delivery roll 834 and a capstan roller 835, and its tension is also regulated by them. As the polishing tape 831, a tape usually called a lapping tape may preferably be used. When the a-Si photoconductive layer or intermediate layer is subjected to surface processing, a lapping tape may be used in which SiC, $Al_2O_3$, $Fe_2O_3$ or the like is used as abrasive grains. Stated specifically, a lapping tape LT-C2000, available from Fuji Photo Film Co., Ltd, is used.

The pressure elastic roller 830 has its roller part made of a material such as neoprene rubber or silicone rubber, and has a JIS rubber hardness in the range of from 20 to 80, and preferably a JIS rubber hardness in the range of from 30 to 40. The roller part may also preferably have such a shape that it has a diameter which is larger at the middle portion than that at both ends, preferably having, e.g., a diameter difference between them in the range of from 0.0 to 0.6 mm, and more preferably in the range from 0.2 to 0.4 mm. The pressure elastic roller 830 is pressed against the processing object member (the surface of the deposited film on the cylindrical substrate) 800 being rotated, at a pressure in the range of from 0.5 kg load/$cm^2$ to 2.0 kg load/$cm^2$, during which the lapping tape 831, e.g., the above lapping tape is fed between them to polish the deposited-film surface.

After the polishing, the processed member is detached and delivered outside the vacuum container 800 via the transport container 860 by the operation exactly opposite to the bringing-in and setting of the processing object member. Thereafter, a post step, e.g., the above washing with water is carried on, which is subsequent to this step of surface processing.

(Means by which Surface Profile is Ascertained Before and After the Surface Processing in the Production Process for the Electrophotographic Photosensitive Member of the Present Invention)

In the electrophotographic photosensitive member of the present invention, the surface protective layer is deposited on the surface of the photoconductive layer or intermediate layer having been subjected to the surface processing. Here, a state is preferred in which, as a result of the surface processing, e.g., the polishing, the surface is selectively processed (polished) only at the part of protrusions and is substantially not processed (polished) at the part of normal areas except the former. More specifically, it is preferred that the vertexes of unwanted protrusions are removed by the selective processing (polishing) to flatten the surface, but, at the part of normal areas except them, has not any processing damage at an atomic level which may be caused by the processing (polishing) and can be a factor of strain or surface (interface) localized levels.

Microscopic changes in surface state before and after this surface processing differ from any macroscopic surface roughness, and changes of microscopic surface profile must be observed. Evaluation of such changes of microscopic surface profile can provide more suitable conditions in respect of the surface processing conditions in the production process for the electrophotographic photosensitive member of the present invention.

Stated specifically, as a means for ascertaining the fact that there are no substantial changes in surface state at the part of normal areas before and after the surface processing, it is preferable to investigate the changes of surface at an atomic level by means of, e.g., an atomic-force microscope (AFM), stated specifically, a commercially available atomic-force microscope (AFM) Q-Scope 250, manufactured by Quesant Co. The reason why an observation means is used which has so high a resolution as to require the use of the atomic-force microscope (AFM) is that, in order to ascertain the presence of any change at the part of normal areas as a result of surface processing, e.g., polishing, what is more important is not to observe any roughness on the order of hundreds of nanometers (nm) which is governed by the surface roughness of the cylindrical substrate itself used, but to take note of finer roughness resulting from the character of the deposited film itself, such as the photoconductive layer or the intermediate layer, and observe its changes exactly.

Such fine roughness can be measured in a high precision and a good reproducibility with, e.g., the AFM by narrowing the range of measurement to 10 $\mu$m×10 $\mu$m and also avoiding any systematic error ascribable to a curvature tilt of sample surface. Stated specifically, as a measuring mode of the above Q-Scope 250, manufactured by Quesant Co., the tilt removal mode may be selected, and, after the curvature an AFM image of the sample has is fitted to a parabola, it is made flat to make correction (parabolic correction). The surface shape of the electrophotographic photosensitive member assumes a cylindrical shape on the whole, and hence the above method of observation making use of the above flattening correction is a preferred method. When any tilt remains in the whole image, the correction to remove the tilt may further be executed (line-by-line correction). Thus, the tilt of sample surface may appropriately be corrected within the range that does not cause any strain in the data. This enables extraction of only the intended information on the finer roughness resulting from the character of the deposited film itself.

Figure 9:
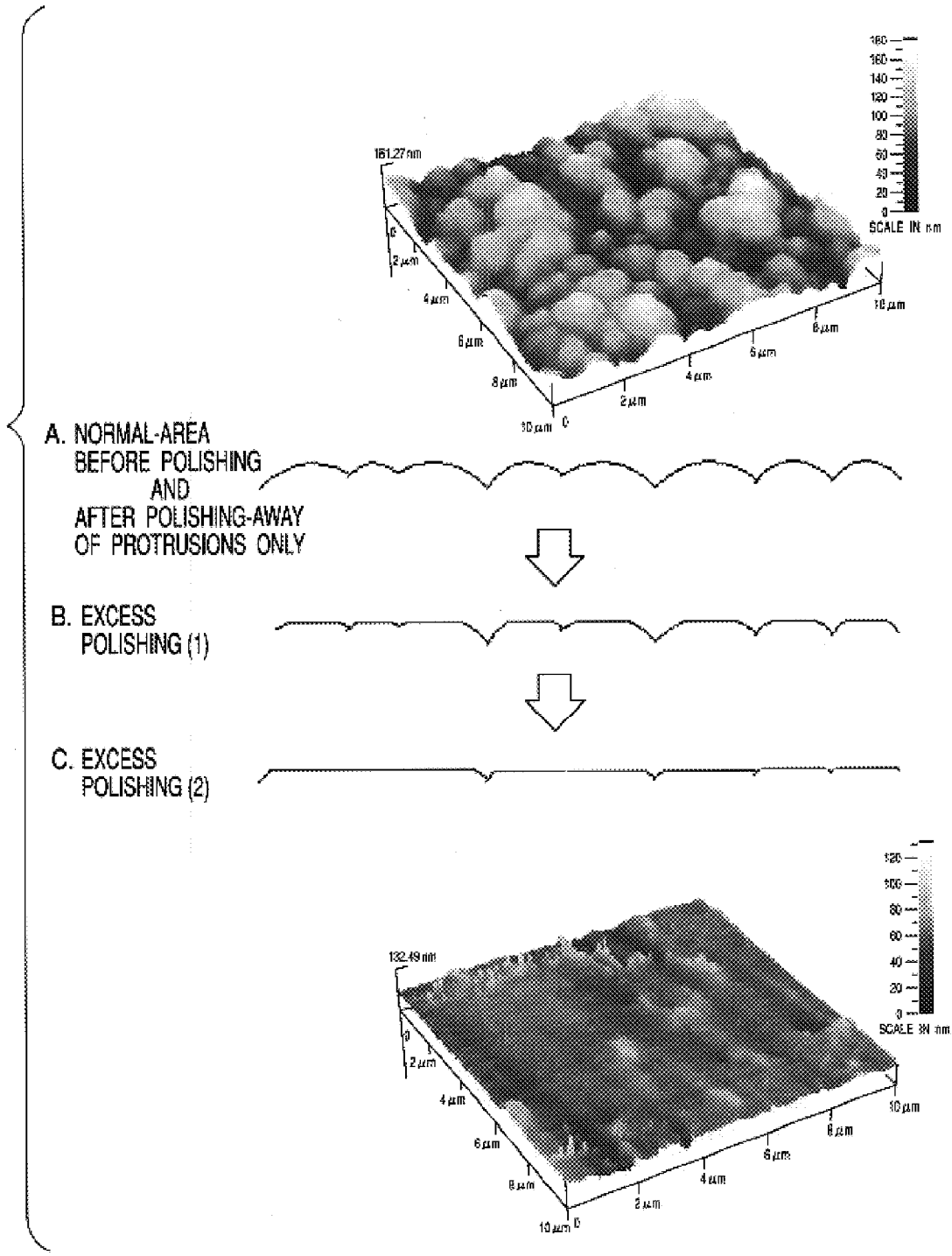
FIG. 9 is a view showing an example of images obtained by atomic-force microscopic observation of an a-Si photoconductive layer surface after its polishing, and diagrammatically illustrating its surface profile, which compare an optimum state of surface processing with a state of excess surface processing, in the steps of producing the electrophotographic photosensitive member according to the present invention.

FIG. 9 shows an example of images obtained by AFM observation of a deposited-film surface, obtained by making the correction as described above. In the electrophotographic photosensitive member of the present invention, the a-Si photoconductive layer or intermediate layer itself is an amorphous deposited film, and its part of normal areas originally shows a natural and gentle unevenness as shown by letter symbol A in FIG. 9. Hence, It is preferred that the surface of the photoconductive layer or intermediate layer having been subjected to the above surface processing also retains this state, i.e., the surface is kept to have the profile also exemplified by the letter symbol A in FIG. 9. There is not any particular problem even when the surface processing is further carried on to a higher level, e.g., even when the surface processing such as polishing is carried on to the stage shown by letter symbol B or C in FIG. 9. However, for achieving what is aimed in the present invention, it is unnecessary to flatten the surface even to such a level which can be said to be excess. In some cases, the film formed may be stripped off to introduce processing strain. The processing strain thus introduced is eliminated after the etching is carried out as described above, and hence it can not be any obstacle to practical use. However, it is unnecessary to carry out any excess polishing too much.

Stated specifically, as a result of the removal of the vertexes of protrusions by polishing or the like, the object surface comes held chiefly by areas of more than about 5 $\mu$m in difference in height (level difference) as the height at the part of vertexes, compared with the surrounding part of normal areas. More specifically, the surface processing may preferably be carried out to a level that, after the processing of making the surface flat by the polishing or the like, the height at portions which had initially been the vertexes of protrusions does not exceed about 5 μm, compared with the surrounding part of normal areas. It is preferable to bring down the height of protrusions to 10% or less with respect to the total layer thickness of the deposited film intended. Here, it is preferred that some unevenness is also present at the surface of the part of normal areas before the surface processing, which unevenness is at a level of about 0.1% of the intended total layer thickness of the deposited film, and that the polishing is not so unnecessarily in excess that even such some unevenness present at the surface of the part of normal areas may disappear as a result of the polishing.

The present invention is described below by giving Examples, comparing them with Comparative Examples.

EXAMPLE 1

Using the a-Si photosensitive member film formation apparatus shown in FIG. 2, a photosensitive member was produced in which a first layer, a-Si:H photoconductive layer was firstly formed on a cylindrical substrate of 108 mm in diameter under conditions shown in Table 1 below.

TABLE 1

| Photoconductive layer: | |
|---|---|
| $SiH_4$ | 500 mL/min. (normal) |
| $H_2$ | 500 mL/min. (normal) |
| Power | 450 W (13.56 MHz) |
| Internal pressure | 73 Pa |
| Substrate temperature | 300° C. |
| Layer thickness | 25 μm |
| Film formation time | 200 min. |

Next, the substrate with the photoconductive layer having firstly been formed thereon was once taken out of the deposition chamber, and was left in the atmosphere to lower the substrate temperature naturally from 300° C. to room temperature. Since the cooling efficiency was high in the atmosphere, the substrate (with film) became cooled to room temperature in about 1 hour. In that course, the deposition chamber was subjected to dry etching under conditions shown in Table 2 below, to remove polysilane having adhered to the interior of the chamber.

TABLE 2

| Etching conditions: | |
|---|---|
| $CF_4$ | 700 mL/min. (normal) |
| $O_2$ | 300 mL/min. (normal) |
| Power | 1,000 W (13.56 MHz) |
| Substrate temperature | room temperature (not heated) |
| Pressure | 50 Pa |
| Etching time | 120 min. |

After the dry etching of the deposition chamber was completed, this room temperature substrate with the photoconductive layer having been deposited thereon was again set in the above deposition chamber, and a second layer, a-C:H surface layer was formed under conditions shown in Table 3 below.

TABLE 3

| a-C Surface layer: | |
|---|---|
| $CH_4$ | 200 mL/min. (normal) |
| Power | 1,000 W (13.56 MHz) |

TABLE 3-continued

| a-C Surface layer: | |
|---|---|
| Internal pressure | 67 Pa |
| Substrate temperature | room temperature (not heated) |
| Layer thickness | 0.5 μm |
| Film formation time | 40 min. |

It took 360 minutes to complete one batch through the foregoing procedure.

The photosensitive member thus produced was evaluated in the following way.

(Evaluation on Melt Adhesion)

The photosensitive members obtained was mounted to a copying machine NP-6085, manufactured by CANON INC., remodeled for this evaluation, and the surface temperature of the photosensitive member was so controlled as to come to 50° C. by means of a photosensitive-member heating means. Setting its processing speed at 400 mm/sec, A4-size paper 100,000-sheet continuous-feed running was tested under environmental conditions of 25° C. and 10% in relative humidity to make evaluation on melt adhesion. Here, as an original, a single-line chart in which a single 1 mm wide black line was printed in a shoulder sash on a white background was used so as to provide a severe environment for the cleaning conditions.

After the running test was completed, a whole-area halftone image and a whole-area white image were reproduced to observe any black spots (dots) caused by the melt adhesion of developer. Also, the surface of the photosensitive member was observed by means of a microscope.

Results obtained were evaluated according to the following criteria.

AA: No melt adhesion was seen on both the images and the photosensitive member surface over the whole areas; very good.

A: Slight melt adhesion occurs on the photosensitive member surface, but does not appear on the images; good.

B: Melt adhesion slightly appearing on the images occurs, and appears and disappears repeatedly, but there is no problem in practical use.

C: Melt adhesion appearing on the images occurs and increases on and on, and there is a problem in practical use.

(Evaluation on Filming)

On the photosensitive member on which the 100,000-sheet running was tested under the above conditions, the layer thickness of its surface layer was measured with a reflection spectrometer. Next, alumina powder with a particle diameter of 100 μm was applied to a wet soft cloth, and the photosensitive member surface was gently rubbed with it 10 times. As the extent of force for this rubbing, a virgin photosensitive member was previously rubbed to make sure that the surface layer did not abrade, and the surface was rubbed at such a force.

Thereafter, the layer thickness of the surface layer was again measured with the reflection spectrometer, and its difference was defined to be the filming level.

Results obtained were evaluated according to the following criteria.

AA: No filming occurs at all; very good.

A: It occurs at a filming level of 50 angstroms or less; good.

B: It occurs at a filming level of 100 angstroms or less, and there is no problem in practical use.

C: It occurs at a filming level of more than 100 angstroms, and there is a possibility of causing, e.g., faulty cleaning.

(Damage of Cleaning Blade Edge)

After the 100,000-sheet running test under the above conditions was completed, whether or not the blade edge stood damaged was observed on an optical microscope to make evaluation.

Results obtained were evaluated according to the following criteria.

AA: The blade looks as good as new; very good.

A: The blade has worn a little at its edge, but any break is seen; good.

B: The blade has broken a little at its edge, but on a level of no difficulty for cleaning.

C: The blade has fairly broken at its edge, and there is a possibility of causing, e.g., faulty cleaning.

(Adherence)

On the photosensitive member on which the 100,000-sheet running test was finished under the above conditions, the adherence of its surface layer was examined with a scratch tester (ST-101, manufactured by Shimadzu Corporation).

Results obtained were evaluated according to the following criteria.

AA: Critical load is 20 g or more; very good.

A: Critical load is 15 g or more; good.

B: Critical load is 10 g or more, and there is no problem in practical use.

C: Critical load is less than 10 g, and there is a possibility of causing a problem in practical use.

(Deposition Chamber Utilization Efficiency)

Deposition chamber utilization efficiency was evaluated according to the time taken for one batch.

Results obtained were evaluated by relative comparison on the basis of Comparative Example 2.

AA: Very good.

A: Good.

B: There is no problem in practical use.

C: There is a problem in practical use.

From the foregoing results, overall evaluation was made. The results are shown in Table 5.

Comparative Example 1

Using the formation apparatus shown in FIG. 2, an a-Si:H photoconductive layer was firstly formed on a cylindrical substrate of 108 mm in diameter under conditions shown in Table 1 above. Thereafter, in the deposition chamber kept vacuum as it was, the substrate (with film) was left therein until the substrate temperature lowered from 300° C. to room temperature. The substrate temperature was monitored with a thermocouple (not shown) attached to the interior of the substrate holder. In this case, it took two hours for the temperature to lower to room temperature.

Next, an a-C:H surface layer was formed under conditions shown in Table 3 above. After the film formation, the photosensitive member thus obtained was taken out. Then, in order to prepare for the next film formation, the deposition chamber was subjected to dry etching under conditions shown in Table 2 above, to remove polysilane having adhered to the interior of the chamber. In the case of Comparative Example 1, however, it took 180 minutes for the polysilane to have completely been removed.

It took 540 minutes to complete one batch through the foregoing procedure.

The photosensitive member thus produced was evaluated in the same manner as in Example 1 to obtain the results shown in Table 5.

Comparative Example 2

Using the a-Si photosensitive member film formation apparatus shown in FIG. 2, an a-Si:H photoconductive layer was firstly formed on a cylindrical substrate of 108 mm in diameter under conditions shown in Table 1 above. Subsequently, a surface layer formed of a-SiC was further formed under conditions shown in Table 4 below. After the film formation, the photosensitive member thus obtained was taken out. Then, in order to prepare for the next film formation, the deposition chamber was subjected to dry etching under conditions shown in Table 2 above, to remove polysilane having adhered to the interior of the chamber.

TABLE 4

| a-SiC Surface layer: | |
|---|---|
| $SiH_4$ | 500 mL/min. (normal) |
| $CH_4$ | 500 mL/min. (normal) |
| Power | 150 W (13.56 MHz) |
| Internal pressure | 67 Pa |
| Substrate temperature | 300° C. |
| Layer thickness | 0.5 μm |
| Film formation time | 40 min. |

It took 360 minutes to complete one batch through the foregoing procedure.

The photosensitive member thus produced was evaluated in the same manner as in Example 1 to obtain the results shown in Table 5. After the evaluation, some part of the photosensitive member was cut out, and the surface layer was compositionally analyzed by XPS (X-ray photoelectron spectroscopy). As the result, Si/(Si+C) was 50%.

TABLE 5

| | Time for one batch | Example 1 360 min. | Comp. Ex. 1 540 min. | Comp. Ex. 2 360 min. |
|---|---|---|---|---|
| Conditions | Intermediate layer | None | None | None |
| | Surface layer | a-C | a-C | a-SiC |
| | Water washing | No | No | No |
| | Etching | No | No | No |
| Evaluation | Melt adhesion | AA | AA | B |
| | Filming | AA | AA | B |
| | Blade damage | AA | AA | B |
| | Adherence | A | AA | A |
| | Deposition chamber utilization efficiency | AA | B | AA |
| | Overall evaluation | A | B | B |

As can be seen from Table 5, the photosensitive member of the present invention shows a remarkable effect of improvement with regard to the melt adhesion, the filming and the blade damage, and also shows a very good deposition chamber utilization efficiency because the time taken per one batch is shortened by as much as 180 minutes compared with Comparative Example 1. From these results, it is seen that the present invention enables production of a high-quality photosensitive member at a low cost.

EXAMPLE 2

Using the a-Si photosensitive member film formation apparatus shown in FIG. 2, films up to an a-Si:H photoconductive layer and an a-SiC:H intermediate layer were formed on a cylindrical substrate of 108 mm in diameter under conditions shown in Table 6 below.

TABLE 6

| | |
|---|---|
| Photoconductive layer: | |
| $SiH_4$ | 500 mL/min. (normal) |
| $H_2$ | 500 mL/min. (normal) |
| Power | 450 W (13.56 MHz) |
| Internal pressure | 73 Pa |
| Substrate temperature | 250° C. |
| Layer thickness | 25 μm |
| Film formation time | 200 min. |
| Intermediate layer: | |
| $SiH_4$ | 50 mL/min. (normal) |
| $CH_4$ | 200 mL/min. (normal) |
| Power | 450 W (13.56 MHz) |
| Internal pressure | 67 Pa |
| Substrate temperature | 250° C. |
| Layer thickness | 0.2 μm |
| Film formation time | 20 min. |

Next, the substrate with these films having been formed thereon was once taken out of the deposition chamber, and was left in the atmosphere to lower the substrate temperature naturally from 250° C. to room temperature. This photosensitive member (unfinished) became cooled to room temperature in about 1 hour. In that course, the deposition chamber was subjected to dry etching under conditions shown in Table 2 above, to remove polysilane having adhered to the interior of the chamber.

After the dry etching of the deposition chamber was completed, this room temperature photosensitive member (unfinished) was again set in the above deposition chamber, and an a-C:H surface layer was formed under conditions shown in Table 7 below.

TABLE 7

| a-C Surface layer: | |
|---|---|
| $CH_4$ | 50 mL/min. (normal) |
| Power | 600 W (13.56 MHz) |
| Internal pressure | 67 Pa |
| Substrate temperature | room temperature (not heated) |
| Layer thickness | 0.3 μm |
| Film formation time | 20 min. |

It took 360 minutes to complete one batch through the foregoing procedure.

The photosensitive member thus produced was evaluated in the same manner as in Example 1 to obtain the results shown in Table 11.

EXAMPLE 3

Using the a-Si photosensitive member film formation apparatus shown in FIG. 2, an a-Si:H photoconductive layer was firstly formed on a cylindrical substrate of 108 mm in diameter under conditions shown in Table 1 above.

Next, the substrate with this film having been formed thereon was once taken out of the deposition chamber, and was left in the atmosphere to lower the substrate temperature naturally from 300° C. to room temperature. This photosensitive member (unfinished) became cooled to room temperature in about 1 hour. In that course, the deposition chamber was subjected to dry etching under conditions shown in Table 2 above, to remove polysilane having adhered to the interior of the chamber.

After the dry etching of the deposition chamber was completed, this room temperature photosensitive member (unfinished) was again set in the above deposition chamber, and an a-SiC:H intermediate layer and an a-C:H surface layer were continuously formed under conditions shown in Table 8 below.

TABLE 8

| | |
|---|---|
| Intermediate layer: | |
| $SiH_4$ | 50 mL/min. (normal) |
| $CH_4$ | 200 mL/min. (normal) |
| Power | 450 W (13.56 MHz) |
| Internal pressure | 67 Pa |
| Substrate temperature | room temperature (not heated) |
| Layer thickness | 0.2 μm |
| Film formation time | 20 min. |
| a-C Surface layer: | |
| $CH_4$ | 50 mL/min. (normal) |
| Power | 600 W (13.56 MHz) |
| Internal pressure | 67 Pa |
| Substrate temperature | room temperature (not heated) |
| Layer thickness | 0.3 μm |
| Film formation time | 20 min. |

It took 360 minutes to complete one batch through the foregoing procedure.

The photosensitive member thus produced was evaluated in the same manner as in Example 1 to obtain the results shown in Table 11.

EXAMPLE 4

Using the a-Si photosensitive member film formation apparatus shown in FIG. 2, films up to an a-Si:H photoconductive layer and an a-SiC:H intermediate layer were formed on a cylindrical substrate of 108 mm in diameter under conditions shown in Table 6 above.

Next, the substrate with these films having been formed thereon was once taken out of the deposition chamber, and was left in the atmosphere to lower the substrate temperature naturally from 250° C. to room temperature. This photosensitive member (unfinished) became cooled to room temperature in about 1 hour. In that course, the deposition chamber was subjected to dry etching under conditions shown in Table 2 above, to remove polysilane having adhered to the interior of the chamber.

After the dry etching of the deposition chamber was completed, this room temperature photosensitive member (unfinished) was again set in the above deposition chamber, and an a-SiC:H intermediate layer and an a-C:H surface layer were continuously formed under conditions shown in Table 8 above.

It took 380 minutes to complete one batch through the foregoing procedure.

The photosensitive member thus produced was evaluated in the same manner as in Example 1 to obtain the results shown in Table 11.

EXAMPLE 5

Using the a-Si photosensitive member film formation apparatus shown in FIG. 2, films up to an a-Si:H photoconductive layer and an a-SiC:H intermediate layer were formed on a cylindrical substrate of 108 mm in diameter under conditions shown in Table 6 above.

Next, the substrate with these films having been formed thereon was once taken out of the deposition chamber, and was left in the atmosphere to lower the substrate temperature naturally from 250° C. to room temperature. This photosensitive member (unfinished) became cooled to room temperature in about 1 hour. In that course, the deposition chamber was subjected to dry etching under conditions shown in Table 2 above, to remove polysilane having adhered to the interior of the chamber.

In the course of the dry etching of the deposition chamber, the photosensitive member (unfinished) having been cooled was put to external-appearance inspection, potential inspection and image inspection. Thereafter, this photosensitive member (unfinished) was washed with water by means of the washer (water washing system) shown in FIG. 4 according to the washing procedure described above, more specifically, by the ultrasonic wave washing in an aqueous solution of surface-active agent, rinsing the member with spraying pure water having a resistivity of 17.5 MΩ·cm, kept at a liquid temperature of 25° C., under a high pressure (4.9 MPa), and drying the member with spraying high temperature gas.

After the dry etching of the deposition chamber was completed, this room temperature photosensitive member (unfinished) was again set in the above deposition chamber, and an a-C:H surface layer was formed under conditions shown in Table 7 above.

It took 360 minutes to complete one batch through the foregoing procedure.

The photosensitive member thus produced was evaluated in the same manner as in Example 1 to obtain the results shown in Table 11.

EXAMPLE 6

Using the a-Si photosensitive member film formation apparatus shown in FIG. 2, films up to an a-Si:H photoconductive layer and an a-SiC:H intermediate layer were formed on a cylindrical substrate of 108 mm in diameter under conditions shown in Table 6 above.

Next, the substrate with these films having been formed thereon was once taken out of the deposition chamber, and was left in the atmosphere to lower the substrate temperature naturally from 250° C. to room temperature. This photosensitive member (unfinished) became cooled to room temperature in about 1 hour. In that course, the deposition chamber was subjected to dry etching under conditions shown in Table 2 above, to remove polysilane having adhered to the interior of the chamber.

In the course of the dry etching of the deposition chamber, the photosensitive member (unfinished) having been cooled was put to external-appearance inspection, potential inspection and image inspection.

After the dry etching of the deposition chamber was completed, this room temperature photosensitive member (unfinished) was again set in the above deposition chamber, and first the surface of the photosensitive member (unfinished) was gently etched with fluorine radicals under conditions shown in Table 9 below. Then, an a-C:H surface layer was formed under conditions shown in Table 7 above.

TABLE 9

| Etching conditions: | |
|---|---|
| $CF_4$ | 500 mL/min. (normal) |
| Power | 500 W (13.56 MHz) |
| Substrate temperature | room temperature (not heated) |

TABLE 9-continued

| Etching conditions: | |
|---|---|
| Pressure | 50 Pa |
| Etching time | 5 min. |

It took 365 minutes to complete one batch through the foregoing procedure.

The photosensitive member thus produced was evaluated in the same manner as in Example 1 to obtain the results shown in Table 11.

EXAMPLE 7

Using the a-Si photosensitive member film formation apparatus shown in FIG. 2, films up to an a-Si:H photoconductive layer and an a-SiC:H intermediate layer were formed on a cylindrical substrate of 108 mm in diameter under conditions shown in Table 6 above.

Next, the substrate with these films having been formed thereon was once taken out of the deposition chamber, and was left in the atmosphere to lower the substrate temperature naturally from 250° C. to room temperature. This photosensitive member (unfinished) became cooled to room temperature in about 1 hour. In that course, the deposition chamber was subjected to dry etching under conditions shown in Table 2 above, to remove polysilane having adhered to the interior of the chamber.

In the course of the dry etching of the deposition chamber, the photosensitive member (unfinished) having been cooled was put to external-appearance inspection, potential inspection and image inspection. Thereafter, this photosensitive member (unfinished) was washed with water by means of the washer shown in FIG. 4 according to the procedure described previously.

After the dry etching of the deposition chamber was completed, this room temperature photosensitive member (unfinished) was again set in the above deposition chamber, and first the surface of the photosensitive member (unfinished) was gently etched under conditions shown in Table 9 above. Then, an a-C:H surface layer was formed under conditions shown in Table 7 above.

It took 365 minutes to complete one batch through the foregoing procedure.

The photosensitive member thus produced was evaluated in the same manner as in Example 1 to obtain the results shown in Table 11.

EXAMPLE 8

Using the a-Si photosensitive member film formation apparatus shown in FIG. 2, films up to an a-Si:H photoconductive layer and an a-SiC:H intermediate layer were formed on a cylindrical substrate of 108 mm in diameter under conditions shown in Table 6 above.

Next, the substrate with these films having been formed thereon was once taken out of the deposition chamber, and was left in the atmosphere to lower the substrate temperature naturally from 250° C. to room temperature. This photosensitive member (unfinished) became cooled to room temperature in about 1 hour. In that course, the deposition chamber was subjected to dry etching under conditions shown in Table 2 above, to remove polysilane having adhered to the interior of the chamber.

In the course of the dry etching of the deposition chamber, the photosensitive member (unfinished) having been cooled was put to external-appearance inspection, potential inspection and image inspection.

After the dry etching of the deposition chamber was completed, this room temperature photosensitive member (unfinished) was again set in the above deposition chamber, and first the surface of the photosensitive member (unfinished) was gently etched with hydrogen radicals under conditions shown in Table 10 below. Then, an a-C:H surface layer was formed under conditions shown in Table 7 above.

TABLE 10

| Etching conditions: | |
|---|---|
| $H_2$ | 500 mL/min. (normal) |
| Power | 200 W (13.56 MHz) |
| Substrate temperature | room temperature (not heated) |
| Pressure | 50 Pa |
| Etching time | 5 min. |

It took 365 minutes to complete one batch through the foregoing procedure.

The photosensitive member thus produced was evaluated in the same manner as in Example 1 to obtain the results shown in Table 11.

As can be seen from Table 11, it has been ascertained that the adherence is improved and better results are obtainable when the a-SiC intermediate layer is inserted between the a-Si photoconductive layer and the a-C surface layer, or when the washing with water or the etching, or the both, is/are added.

naturally from 300° C. to room temperature. Since the cooling efficiency was high in the atmosphere, this photosensitive member (unfinished) became cooled to room temperature in about 1 hour. In that course, the deposition chamber was subjected to dry etching under conditions shown in Table 2 above, to remove polysilane having adhered to the interior of the chamber.

After the dry etching of the deposition chamber was completed, this room temperature photosensitive member (unfinished) was again set in the above deposition chamber, and an a-C:H surface layer was formed under conditions shown in Table 12 below. In this Example, silicon atoms were introduced into the a-C:H surface layer in a very small quantity.

TABLE 12

| a-C Surface layer: | |
|---|---|
| $CH_4$ | 100 mL/min. (normal) |
| $SiH_4$ | (changed; as shown in Table 13) |
| Power | 1,200 W (13.56 MHz) |
| Internal pressure | 34 Pa |
| Substrate temperature | room temperature (not heated) |
| Layer thickness | 0.5 $\mu$m |
| Film formation time | 40 min. |

It took 360 minutes to complete one batch through the foregoing procedure.

Seven drums A to G were produced as photosensitive members according to the above procedure. The photosensitive members thus produced were evaluated in the same manner as in Example 1. After the evaluation, some part of each photosensitive member was cut out, and the surface layer was compositionally analyzed by XPS (X-ray photoelectron spectroscopy). The results are shown in Table 13.

As can be seen from Table 13, good results are obtainable also when silicon atoms are contained in the a-C surface layer in an amount of about 10 atomic %.

TABLE 11

| | | Example 2 | Example 3 | Example 4 | Example 5 | Example 6 | Example 7 | Example 8 |
|---|---|---|---|---|---|---|---|---|
| Conditions | Time for one batch | 360 min. | 360 min. | 380 min. | 360 min. | 365 min. | 365 min. | 365 min. |
| | First-layer's intermediate layer | a-SiC | None | a-SiC | a-SiC | a-SiC | a-SiC | a-SiC |
| | Second-layer's intermediate layer | None | a-SiC | a-SiC | None | None | None | None |
| | Surface layer | a-C | a-C | a-C | a-C | a-C | a-C | a-C |
| | Interface treatment | None | None | None | Water washing | F-radical etching | Water washing & F-radical etching | H-radical etching |
| Evaluation | Melt adhesion | AA | AA | AA | AA | AA | AA | AA |
| | Filming | AA | AA | AA | AA | AA | AA | AA |
| | Blade damage | AA | AA | AA | AA | AA | AA | AA |
| | Adherence | AA | AA | AA | AA | AA | AA | AA |
| | Deposition chamber utilization efficiency | AA | AA | AA | AA | AA | AA | AA |
| | Overall evaluation | AA | AA | AA | AA | AA | AA | AA |

EXAMPLE 9

Using the a-Si photosensitive member film formation apparatus shown in FIG. 2, an a-Si:H photoconductive layer was formed on a cylindrical substrate of 108 mm in diameter under conditions shown in Table 1 above.

Next, the substrate with the film having been formed thereon was once taken out of the deposition chamber, and was left in the atmosphere to lower the substrate temperature

TABLE 13

| Drum | | Example 9 | | | | | | |
|---|---|---|---|---|---|---|---|---|
| | | A | B | C | D | E | F | G |
| Evaluation | $SiH_4$ flow rate (mL/min) | 0.5 | 1 | 2 | 6 | 12 | 20 | 25 |
| | Silicon content in surface layer (atomic %) | 0.2 | 0.5 | 1 | 5 | 10 | 15 | 20 |
| | Melt adhesion | AA | AA | AA | AA | A | A | B |
| | Filming | AA | AA | AA | AA | A | A | B |
| | Blade damage | AA | AA | AA | AA | AA | A | B |
| | Adherence | A | A | A | A | A | A | A |
| | Deposition chamber utilization efficiency | AA | AA | AA | AA | AA | AA | AA |
| | Overall evaluation | AA | AA | AA | AA | AA | A | A |

EXAMPLE 10

Using the a-Si photosensitive member film formation apparatus shown in FIG. 3, making use of VHF plasma-assisted CVD, films up to an a-Si:H photoconductive layer and an a-SiC:H intermediate layer were formed on a cylindrical substrate of 108 mm in diameter under conditions shown in Table 14 below.

Next, the substrate with these films having been formed thereon was once taken out of the deposition chamber, and was left in the atmosphere to lower the substrate temperature naturally from 200° C. to room temperature. This photosensitive member (unfinished) became cooled to room temperature in about 1 hour. In that course, the deposition chamber was subjected to dry etching under conditions shown in Table 15 below, to remove a-Si films having adhered to the interior of the chamber.

In the course of the dry etching of the deposition chamber, the photosensitive member (unfinished) having been cooled was put to external-appearance inspection, potential inspection and image inspection. Thereafter, this photosensitive member (unfinished) was washed with water by means of the washer shown in FIG. 4 according to the same washing procedure as in Example 5.

After the dry etching of the deposition chamber was completed, this room temperature photosensitive member (unfinished) was again set in the above deposition chamber, and first the surface of the photosensitive member (unfinished) was gently etched under conditions shown in Table 16 below. Then, an a-C:H surface layer was formed under conditions shown in Table 17 below.

In respect of the photosensitive member the surface layer of which was formed under room temperature conditions, it took 385 minutes to complete one batch through the foregoing procedure. In respect of those of other conditions, it each took a time to which the heating time was further added.

The photosensitive members thus produced were evaluated on sensitivity and also evaluated in the same manner as in Example 1 to obtain the results shown in Table 18.

TABLE 14

| Photoconductive layer: | |
|---|---|
| $SiH_4$ | 150 mL/min. (normal) |
| $H_2$ | 300 mL/min. (normal) |
| Power | 1,500 W (105 MHz) |
| Internal pressure | 0.8 Pa |
| Substrate temperature | 200° C. |
| Layer thickness | 25 μm |
| Film formation time | 200 min. |
| Intermediate layer: | |
| $SiH_4$ | 50 mL/min. (normal) |
| $CH_4$ | 50 mL/min. (normal) |
| Power | 500 W (105 MHz) |
| Internal pressure | 0.8 Pa |
| Substrate temperature | 200° C. |
| Layer thickness | 0.2 μm |
| Film formation time | 20 min. |

TABLE 15

| Etching conditions: | |
|---|---|
| $CF_4$ | 500 mL/min. (normal) |
| $O_2$ | 100 mL/min. (normal) |
| Power | 1,000 W (105 MHz) |
| Substrate temperature | room temperature (not heated) |
| Pressure | 1 Pa |
| Etching time | 120 min. |

TABLE 16

| Etching conditions: | |
|---|---|
| $CF_4$ | 500 mL/min. (normal) |
| Power | 1,000 W (105 MHz) |
| Substrate temperature | room temperature (not heated) |
| Pressure | 0.8 Pa |
| Etching time | 5 min. |

TABLE 17

| a-C Surface layer: | |
|---|---|
| $CH_4$ | 100 mL/min. (normal) |
| Power | 2,000 W (105 MHz) |
| Internal pressure | 0.8 Pa |
| Substrate temperature | from room temperature (not heated) to 200° C. |
| Layer thickness | 0.5 μm |
| Film formation time | 40 min. |

(Evaluation of Sensitivity)

The electrophotographic photosensitive member is electrostatically charged to a certain dark-area surface potential (400 V), and then immediately exposed to light image. As the light image, a xenon lamp is used as a light source and the photosensitive member is exposed to light from which the light within a wave range of 600 nm or more has been removed using a filter. At the time of this exposure, the light-area surface potential of the electrophotographic photosensitive member is measured with a surface potentiometer. The amount of exposure is so adjusted that the light-area surface potential may come to a stated potential (50 V), and the amount of exposure at such adjustment is regarded as sensitivity to make evaluation.

Here, as evaluation by comparison, the sensitivity (amount of exposure) of the photosensitive member produced in Comparative Example 2 is regarded as 50, and the sensitivity was ranked by relative comparison with the amount of exposure in each photosensitive member and judged in the following way.

Judgement criteria:

AA: 30 or less.

A: More than 30 to 40.

B: More than 40 to 50.

C: More than 50.

Comparative Example 3

Using the a-Si photosensitive member formation apparatus shown in FIG. 3, an a-Si:H photoconductive layer and an a-SiC:H intermediate layer were firstly formed on a cylindrical substrate of 108 mm in diameter under conditions shown in Table 14 above. Thereafter, in the deposition chamber kept vacuum as it was, the substrate (with film) was left therein until the substrate temperature lowered from 200° C. to room temperature. The substrate temperature was monitored with a thermocouple (not shown) attached to the interior of the substrate holder. In this case, it took two hours for the temperature to lower to room temperature.

Next, an a-C:H surface layer was formed under conditions shown in Table 17 above. After the film formation, the photosensitive member obtained was taken out. Then, in order to prepare for the next film formation, the deposition chamber was subjected to dry etching under conditions shown in Table 15 above, to remove a-Si films having adhered to the interior of the chamber.

It took 500 minutes to complete one batch through the foregoing procedure.

The photosensitive member thus produced was evaluated in the same manner as in Example 10 to obtain the results shown in Table 18.

As can be seen from the results shown in Table 18, according to the present invention, a photosensitive member with superior performance can be produced in a time of 385 minutes, which is shorter as much as 115 minutes than 500 minutes in the conventional one, so that the number of photosensitive members to be produced per one deposition chamber can be set larger and consequently the cost reduction can be achieved.

EXAMPLE 11

Using the a-Si photosensitive member film formation apparatus shown in FIG. 2, films up to an a-Si:H photoconductive layer and an a-SiC:H intermediate layer were formed on a cylindrical substrate of 108 mm in diameter under conditions shown in Table 6 above.

Next, the substrate with these films having been formed thereon was once taken out of the deposition chamber, and was left in the atmosphere to lower the substrate temperature naturally from 250° C. to room temperature. Since the cooling efficiency was high in the atmosphere, this photosensitive member (unfinished) became cooled to room temperature in about 1 hour. In that course, the deposition chamber was subjected to dry etching under conditions shown in Table 2 above, to remove polysilane having adhered to the interior of the chamber.

In the course of the dry etching of the deposition chamber, the photosensitive member (unfinished) having been cooled was put to external-appearance inspection, potential inspection and image inspection. Then, only when the photosensitive member was accepted in the inspection, it was subsequently set in the deposition chamber, and an a-C:H surface layer was formed under conditions shown in Table 7 above. When it was not accepted in the inspection, the formation of the surface layer was stopped, and the procedure was passed to film formation for the next photosensitive member.

Film formation for 20 batches was tested according to the foregoing procedure. During this film formation, in this Example, two photosensitive members were judged to be defective in the inspection, and the formation of the surface layer was stopped. Hence, the total time taken to carry out the film formation for 20 batches was shortened by 40 minutes, thus the utilization efficiency of the deposition chamber was more improved. It was also possible to save any wasteful consumption of gases to contribute to the cost reduction.

EXAMPLE 12

In this Example, a photosensitive member with the basic construction shown in FIG. 6C was produced, i.e., the one in which the a-Si:H photoconductive layer 602 and the a-SiC:H intermediate layer 605 were deposited on the con-

TABLE 18

| | | Example 10 | | | | | Comparative Example 3 |
|---|---|---|---|---|---|---|---|
| Conditions | a-C:H surface layer film formation temperature | Room temperature | 50° C. | 100° C. | 150° C. | 200° C. | Room temperature |
| | Time for one batch | 385 min. | 400 min. | 420 min. | 440 min. | 460 min. | 500 min. |
| | First-layer's intermediate layer | a-SiC | a-SiC | a-SiC | a-SiC | a-SiC | a-SiC |
| | Second-layer's intermediate layer | None | None | None | None | None | None |
| | Surface layer | a-C | a-C | a-C | a-C | a-C | a-C |
| | Interface treatment | F-radical etching | F-radical etching | F-radical etching | F-radical etching | F-radical etching | None |
| Evaluation | Sensitivity | AA | A | A | A | B | AA |
| | Melt Adhesion | AA | AA | AA | AA | AA | AA |
| | Filming | AA | AA | AA | AA | AA | AA |
| | Blade damage | AA | AA | AA | AA | AA | AA |
| | Adherence | AA | AA | AA | AA | AA | AA |
| | Deposition chamber utilization efficiency | AA | AA | AA | A | A | B |
| | Overall evaluation | AA | A | A | A | A | B |

ductive cylindrical substrate 601 by plasma-assisted CVD and, after this deposited film surface was subjected to polishing in the atmosphere to remove the vertexes of protrusions 604 to flatten the surface, the a-C:H surface protective layer 603 was formed thereon.

First, using the plasma-assisted CVD film formation apparatus constructed as shown in FIG. 11, deposited films were prepared by forming an a-Si:H photoconductive layer and an a-SiC:H intermediate layer continuously on a cylindrical aluminum substrate of 108 mm in outer diameter.

Next, this cylindrical substrate with deposited films was taken out of the film formation apparatus. In respect of the deposited films thus formed, having the protrusions as shown in FIG. 6A, only the part of protrusions was selectively polished away by surface polishing in the atmosphere by means of the polishing apparatus having the construction diagrammatically shown in FIG. 7, to flatten the surface as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions.

Next, the cylindrical substrate having the a-Si:H photoconductive layer and the a-SiC:H intermediate layer having been surface-polished was again set in the above plasma-assisted CVD film formation apparatus constructed as shown in FIG. 11, and the a-C:H surface protective layer was formed.

Conditions used in this Example when the a-Si:H photoconductive layer, the a-SiC:H intermediate layer and the a-C:H surface protective layer were deposited by plasma-assisted CVD and their deposited-film thickness are shown in Table 19.

In this Example, the cylindrical substrate used was a cylindrical conductive substrate made of aluminum, having an outer diameter of 108 mm and a wall thickness of 5 mm, the surface of which was mirror-polished and on the surface of which a lower-part blocking layer, the photoconductive layer and the intermediate layer were deposited in order. After the polishing, the surface protective layer (surface layer) was deposited on its surface to produce an a-Si photosensitive member for negative charging. Also, as high-frequency power for the plasma-assisted CVD film formation apparatus, power with a frequency of 13.56 MHz (RF) was used.

TABLE 19

| Gases and flow rates | Lower-part blocking layer | Photo-conductive layer | Inter-mediate layer | Surface layer |
|---|---|---|---|---|
| $SiH_4$ (mL/min(normal)) | 100 | 200 | 10 | |
| $H_2$ (mL/min(normal)) | 600 | 800 | | |
| $PH_3$ (PPM) (based on $SiH_4$) | | | | |
| NO (mL/min(normal)) | 8 | | | |
| $CH_4$ (mL/min(normal)) | | | 600 | 100 |
| Substrate temperature (° C.) | 260 | 260 | 260 | 50 |
| Internal pressure (Pa) | 64 | 78 | 60 | 60 |

TABLE 19-continued

| Gases and flow rates | Lower-part blocking layer | Photo-conductive layer | Inter-mediate layer | Surface layer |
|---|---|---|---|---|
| High-frequency power (W) | 100 | 600 | 180 | 1500 |
| Layer thickness (μm) | 1 | 25 | 0.5 | 0.3 |

On the electrophotographic photosensitive member produced according to the above procedure, the surface appearance of its deposited-film layer was observed to evaluate the adherence of film. Next, to evaluate its electrophotographic performance, images were formed using the electrophotographic photosensitive member produced in this Example, which was mounted as a light-receiving member to an electrophotographic apparatus provided with a primary charging assembly employing corona discharge and also a cleaner having a cleaning blade. Stated specifically, using GP605 (process speed: 300 mm/sec.), manufactured by CANON INC., as a testing electrophotographic apparatus, 5,000,000-sheet paper feed running was tested using a test pattern having a print area percentage of 1%, which was a print area percentage made lower than usual. During the testing, a whole-area halftone image and a whole-area white image were periodically reproduced to make evaluation on any melt adhesion of toner to the photosensitive member surface and any occurrence of spots. Also, after the 5,000,000-sheet paper feed running was finished, whether or not the blade edge stood damaged was examined to make evaluation. On the basis of the results concerning these evaluation items, overall evaluation was made. The results of evaluation are shown in Table 24.

EXAMPLE 13

In this Example, a photosensitive member with the basic construction shown in FIG. 6C was produced, i.e., the one in which the a-Si:H photoconductive layer 602 and the a-SiC:H intermediate layer 605 were deposited on the conductive cylindrical substrate 601 by plasma-assisted CVD and, after this deposited film surface was subjected to polishing in vacuum to remove the vertexes of protrusions 604 to flatten the surface, the a-C:H surface protective layer 603 was formed thereon.

First, using the plasma-assisted CVD film formation apparatus constructed as shown in FIG. 11, deposited films were prepared by forming an a-Si:H photoconductive layer and an a-SiC:H intermediate layer continuously on a cylindrical aluminum substrate of 108 mm in outer diameter.

Next, this cylindrical substrate with deposited films thus formed, having the protrusions as shown in FIG. 6A, was, being kept in vacuum, moved from the deposited-film formation apparatus to the vacuum polishing apparatus having the construction diagrammatically shown in FIG. 8. Then, using this polishing apparatus, only the part of protrusions was selectively polished away by surface polishing in vacuum to flatten the surface as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions.

Next, the cylindrical substrate having the a-Si:H photoconductive layer and the a-SiC:H intermediate layer having been surface-polished was, being kept in vacuum, moved from the vacuum polishing apparatus to the above deposited-film formation apparatus constructed as shown in FIG. 11, and was again set therein, where the a-C:H surface protective layer was formed.

Conditions used in this Example when the a-Si:H photoconductive layer, the a-SiC:H intermediate layer and the a-C:H surface protective layer were deposited by plasma-assisted CVD and their deposited-film thickness are the same as those in Example 12.

On the electrophotographic photosensitive member thus obtained, too, evaluation was made on the same evaluation items (i.e., adherence of film, melt adhesion of toner, occurrence of spots, and blade edge damage), according to the same procedure and under the same evaluation conditions as those in Example 12. Also, on the basis of the results concerning these evaluation items, overall evaluation was made. The results of evaluation are shown in Table 24.

EXAMPLE 14

In this Example, a photosensitive member with the basic construction shown in FIG. 6C was produced, i.e., the one in which the a-Si:H photoconductive layer 602 and the a-SiC:H intermediate layer 605 were deposited on the conductive cylindrical substrate 601 by plasma-assisted CVD and, after this deposited film surface was subjected to polishing in the atmosphere to remove the vertexes of protrusions 604 to flatten the surface and further the polished surface was treated by water washing, the a-C:H surface protective layer 603 was formed thereon.

First, using the plasma-assisted CVD film formation apparatus constructed as shown in FIG. 11, deposited films were prepared by forming an a-Si:H photoconductive layer and an a-SiC:H intermediate layer continuously on a cylindrical aluminum substrate of 108 mm in outer diameter.

Next, this cylindrical substrate with deposited films was taken out of the film formation apparatus. In respect of the deposited films thus formed, having the protrusions as shown in FIG. 6A, only the part of protrusions was selectively polished away by surface polishing in the atmosphere by means of the polishing apparatus having the construction diagrammatically shown in FIG. 7, to flatten the surface as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions.

The cylindrical substrate surface deposited film having been subjected to surface processing was further subjected to water washing, and thereafter again set in the above plasma-assisted CVD film formation apparatus constructed as shown in FIG. 11, and the a-C:H surface protective layer was formed. In this Example, the water washing was carried out under conditions shown in Table 20, by means of the water washing system shown in FIG. 4, consisting chiefly of the wash chamber, the pure-water contact chamber and the drying chamber.

TABLE 20

| Treating conditions | Washing (pre-washing) | Pure-water contact (washing with $CO_2$-containing pure water) | Drying |
|---|---|---|---|
| Treating agent | Nonionic-surfactant-containing pure-water solution | $CO_2$-containing pure water (conductivity: 20 $\mu$S/cm) | Dry inert gas (nozzle spraying) |
| Temperature | 30° C. | 25° C. | 50° C. |
| Time | 3 min. | 60 sec. | 2 min. |
| Remarks | In combination with ultrasonic cleaning | | |

Conditions used in this Example when the a-Si:H photoconductive layer, the a-SiC:H intermediate layer and the a-C:H surface protective layer were deposited by plasma-assisted CVD and their deposited-film thickness are the same as those in Example 12.

On the electrophotographic photosensitive member thus obtained, too, evaluation was made on the same evaluation items (i.e., adherence of film, melt adhesion of toner, occurrence of spots, and blade edge damage), according to the same procedure and under the same evaluation conditions as those in Example 12. Also, on the basis of the results concerning these evaluation items, overall evaluation was made. The results of evaluation are shown in Table 24.

EXAMPLE 15

In this Example, a photosensitive member was produced in which the a-Si:H photoconductive layer 602 was deposited on the conductive cylindrical substrate 601 by plasma-assisted CVD and, after this deposited film surface was subjected to polishing in the atmosphere to remove the vertexes of protrusions 604 to flatten the surface, the a-C:H surface protective layer 603 was further formed thereon.

First, using the plasma-assisted CVD film formation apparatus constructed as shown in FIG. 11, a deposited film was prepared by forming only an a-Si:H photoconductive layer on a cylindrical aluminum substrate of 108 mm in outer diameter. In this deposited film, too, though any a-SiC:H intermediate layer was not formed, protrusions having occurred during the deposition of the a-Si:H photoconductive layer were seen as shown in FIG. 6A.

Next, this cylindrical substrate with deposited film was taken out of the film formation apparatus. In respect of the deposited film thus formed, having the protrusions having occurred in the a-Si:H photoconductive layer, only the part of protrusions was selectively polished away by surface polishing in the atmosphere by means of the polishing apparatus having the construction diagrammatically shown in FIG. 7, to flatten the surface in such a way that the difference in height arising from the protrusions was brought down to the level as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions.

Subsequently, the cylindrical substrate (with film) having been subjected to surface processing was again set in the above plasma-assisted CVD film formation apparatus constructed as shown in FIG. 11, and the a-C:H surface protective layer was formed.

Conditions used in this Example when the a-Si:H photoconductive layer and the a-C:H surface protective layer were deposited by plasma-assisted CVD and their deposited-film thickness are the same as those in Example 12.

On the electrophotographic photosensitive member thus obtained, too, evaluation was made on the same evaluation items (i.e., adherence of film, melt adhesion of toner, occurrence of spots, and blade edge damage), according to the same procedure and under the same evaluation conditions as those in Example 12. Also, on the basis of the results concerning these evaluation items, overall evaluation was made. The results of evaluation are shown in Table 24.

EXAMPLE 16

In this Example, a photosensitive member was produced in which the a-Si:H photoconductive layer 602 was deposited on the conductive cylindrical substrate 601 by plasma-assisted CVD and, after this deposited film surface was subjected to polishing in the atmosphere to remove the vertexes of protrusions 604 to flatten the surface and further the polished surface was subjected to etching with an etching gas under discharge of plasma immediately before the next film was deposited, the a-C:H surface protective layer 603 was formed on the surface having been subjected to etching.

First, using the plasma-assisted CVD film formation apparatus constructed as shown in FIG. 11, a deposited film was prepared by forming only an a-Si:H photoconductive layer on a cylindrical aluminum substrate of 108 mm in outer diameter. In this deposited film, too, though any a-SiC:H intermediate layer was not formed, protrusions having occurred during the deposition of the a-Si:H photoconductive layer were seen as shown in FIG. 6A.

Next, this cylindrical substrate with deposited film was taken out of the film formation apparatus. In respect of the deposited film thus formed, having the protrusions having occurred in the a-Si:H photoconductive layer, only the part of protrusions was selectively polished away by surface polishing in the atmosphere by means of the polishing apparatus having the construction diagrammatically shown in FIG. 7, to flatten the surface in such a way that the difference in height arising from the protrusions was brought down to the level as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions.

Subsequently, the cylindrical substrate (with film) having been subjected to surface processing was again set in the above plasma-assisted CVD film formation apparatus constructed as shown in FIG. 11. The surface of the a-Si:H photoconductive layer having been subjected to surface processing was subjected to gas-phase etching, and subsequently the a-C:H surface protective layer was formed. In this Example, the gas-phase etching was carried out using $CF_4$ gas under conditions shown in Table 21.

TABLE 21

| Gases and flow rates | Gas-phase etching |
|---|---|
| $CF_4$ (mL/min(normal)) | 500 |
| Substrate temperature (° C.) | 50 |
| Internal pressure (Pa) | 53 |
| High-frequency power (W) | 500 |

Conditions used in this Example when the a-Si:H photoconductive layer and the a-C:H surface protective layer were deposited by plasma-assisted CVD and their deposited-film thickness are the same as those in Example 12.

On the electrophotographic photosensitive member thus obtained, too, evaluation was made on the same evaluation items (i.e., adherence of film, melt adhesion of toner, occurrence of spots, and blade edge damage), according to the same procedure and under the same evaluation conditions as those in Example 12. Also, on the basis of the results concerning these evaluation items, overall evaluation was made. The results of evaluation are shown in Table 24.

Comparative Example 4

In this Comparative Example, the a-Si:H photoconductive layer 602, the a-SiC:H intermediate layer 605 and the a-C:H surface protective layer 603 were continuously deposited on the conductive cylindrical substrate 601 by plasma-assisted CVD. This triple-structure deposited film surface was subjected to polishing in the atmosphere to remove the vertexes of protrusions 604 to flatten the surface, thus a photosensitive member was produced. Thus, as a result of the removing of the vertexes of protrusions 604 by the above polishing, the a-C:H surface protective layer 603 and a-SiC:H intermediate layer 605 which had covered the vertexes came lost there.

First, using the plasma-assisted CVD film formation apparatus constructed as shown in FIG. 11, a triple-structure deposited film was prepared by continuously forming an a-Si:H photoconductive layer, an a-SiC:H intermediate layer and an a-C:H surface protective layer on a cylindrical aluminum substrate of 108 mm in outer diameter. In this deposited film, though the uppermost layer a-C:H surface protective layer also took part, protrusions having occurred during the deposition of the a-Si:H photoconductive layer were seen as shown in FIG. 6A. At the vertexes of such protrusions, like the a-SiC:H intermediate layer, the a-C:H surface protective layer also stood deposited in such a form that it covered the protrusion surfaces.

Conditions used in this Comparative Example when the a-Si:H photoconductive layer, the a-SiC:H intermediate layer and the a-C:H surface protective layer were deposited by plasma-assisted CVD and their deposited-film thickness are the same as those in Example 12.

Next, in respect of this triple-structure deposited film thus formed, having the protrusions having occurred in the a-Si:H photoconductive layer, only the part of protrusions was selectively polished away by surface polishing in the atmosphere by means of the polishing apparatus having the construction diagrammatically shown in FIG. 7, to flatten the surface in such a way that the difference in height arising from the protrusions was brought down to the level as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions. As the result, both the a-SiC:H intermediate layer and the a-C:H surface protective layer remained at the part except the protrusions, but the a-SiC:H intermediate layer and a-C:H surface protective layer which had covered the vertexes of protrusions removed by the surface polishing were polished away and removed like the state shown in FIG. 6B, and the rest of protrusions composed of a-Si:H came uncovered to the surface.

On the electrophotographic photosensitive member thus obtained, too, evaluation was made on the same evaluation items (i.e., adherence of film, melt adhesion of toner, occurrence of spots, and blade edge damage), according to the same procedure and under the same evaluation conditions as those in Example 12. Also, on the basis of the results concerning these evaluation items, overall evaluation was made. The results of evaluation are shown in Table 24.

Comparative Example 5

In this Comparative Example, the a-Si:H photoconductive layer 602, the a-SiC:H intermediate layer 605 and the a-C:H surface protective layer 603 were continuously deposited on the conductive cylindrical substrate 601 by plasma-assisted CVD to obtain a photosensitive member as it was.

Stated specifically, using the plasma-assisted CVD film formation apparatus constructed as shown in FIG. 11, a triple-structure deposited film was prepared by continuously forming an a-Si:H photoconductive layer, an a-SiC:H intermediate layer and an a-C:H surface protective layer on a cylindrical aluminum substrate of 108 mm in outer diameter. In this deposited film, though the uppermost layer a-C:H surface protective layer also took part, protrusions having occurred during the deposition of the a-Si:H photoconductive layer were seen as shown in FIG. 6A. At the vertexes of such protrusions, like the a-SiC:H intermediate layer, the a-C:H surface protective layer also stood deposited in such a form that it covered the protrusion surfaces. Hence, the difference in height between the part of such protrusions and the surrounding part of flat areas was left not to have been dealt with at all.

Conditions used in this Comparative Example when the a-Si:H photoconductive layer, the a-SiC:H intermediate layer and the a-C:H surface protective layer were deposited by plasma-assisted CVD and their deposited-film thickness are the same as those in Example 12.

On the electrophotographic photosensitive member thus obtained, too, evaluation was made on the same evaluation items (i.e., adherence of film, melt adhesion of toner, occurrence of spots, and blade edge damage), according to the same procedure and under the same evaluation conditions as those in Example 12. Also, on the basis of the results concerning these evaluation items, overall evaluation was made. The results of evaluation are shown in Table 24.

EXAMPLE 17

In this Example, a photosensitive member with the basic construction shown in FIG. 6C was produced, i.e., the one in which the a-Si:H photoconductive layer 602 and the a-SiC:H intermediate layer 605 were deposited on the conductive cylindrical substrate 601 by plasma-assisted CVD and, after this deposited film surface was subjected to polishing in the atmosphere to remove the vertexes of protrusions 604 to flatten the surface, the a-C:H surface protective layer 603 was formed thereon.

First, using the plasma-assisted CVD film formation apparatus constructed as shown in FIG. 11, deposited films were prepared by forming an a-Si:H photoconductive layer and an a-SiC:H intermediate layer continuously on a cylindrical aluminum substrate of 30 mm in outer diameter.

Next, this cylindrical substrate with deposited films was taken out of the film formation apparatus. In respect of the deposited films thus formed, having the protrusions as shown in FIG. 6A, only the part of protrusions was selectively polished away by surface polishing in the atmosphere by means of the polishing apparatus having the construction diagrammatically shown in FIG. 7, to flatten the surface as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions.

Next, the cylindrical substrate having the a-Si:H photoconductive layer and the a-SiC:H intermediate layer having been surface-polished was again set in the above plasma-assisted CVD film formation apparatus constructed as shown in FIG. 11, and the a-C:H surface protective layer was formed.

Conditions used in this Example when the a-Si:H photoconductive layer, the a-SiC:H intermediate layer and the a-C:H surface protective layer were deposited by plasma-assisted CVD and their deposited-film thickness are shown in Table 22.

In this Example, as the cylindrical substrate used was a cylindrical conductive substrate made of aluminum, having an outer diameter of 30 mm and a wall thickness of 2.5 mm, the surface of which was mirror-polished and on the surface of which a lower-part blocking layer, the photoconductive layer and the intermediate layer were deposited in order. After the polishing, the surface protective layer (surface layer) was deposited on its surface to produce an a-Si photosensitive member for negative charging. Also, as high-frequency power for the plasma-assisted CVD film formation apparatus, power with a frequency of 105 MHz (VHF) was used.

TABLE 22

| Gases and flow rates | Lower-part blocking layer | Photo-conductive layer | Inter-mediate layer | Surface layer |
|---|---|---|---|---|
| $SiH_4$ (mL/min(normal)) | 200 | 200 | 20 | |
| $H_2$ (mL/min(normal)) | 400 | 400 | | |
| $PH_3$ (PPM) (based on $SiH_4$) | 2000 | | | |
| NO (mL/min(normal)) | 10 | | | |
| $CH_4$ (mL/min(normal)) | | | 50 | 50 |
| Substrate temperature (° C.) | 250 | 250 | 250 | 100 |
| Internal pressure (Pa) | 0.8 | 0.8 | 0.8 | 0.5 |
| High-frequency power (W) | 1200 | 1200 | 1200 | 1500 |
| Layer thickness (μm) | 2 | 30 | 0.3 | 0.5 |

On the electrophotographic photosensitive member produced according to the above procedure, the surface appearance of its deposited-film layer was observed to evaluate the adherence of film. Next, to evaluate its electrophotographic performance, images were formed using the electrophotographic photosensitive member produced in this Example, which was mounted as a light-receiving member to an electrophotographic apparatus provided with a primary charging assembly employing injection discharge and also a roller for the injection discharge, made to have a cleaning function to omit the cleaning blade. Stated specifically, GP405 (process speed: 210 mm/sec.), manufactured by CANON INC., was remodeled into a testing electrophotographic apparatus to set up a cleanerless system according to the method disclosed in Japanese Patent Application Laid-Open No. 11-190927, i.e., by changing its charging member to an elastic roller formed of a medium-resistance layer, employing a method in which a voltage was applied to this elastic roller in the state the roller was kept coated with conductive particles, and providing a form in which this roller was brought into contact with the photosensitive member in the state the roller was kept coated with the conductive particles, to remove residual toner and so forth. Using this testing apparatus, 1,000,000-sheet paper feed running was tested using a test pattern having a print area percentage of 1%, which was a print area percentage made lower than usual. During the testing, a whole-area halftone image and a whole-area white image were periodically reproduced to make evaluation on any melt adhesion of toner to the photosensitive member surface and any occurrence of spots. On the basis of the results concerning these evaluation items, overall evaluation was made. The results of evaluation are shown in Table 24.

Comparative Example 6

In this Comparative Example, the a-Si:H photoconductive layer 602, the a-SiC:H intermediate layer 605 and the a-C:H surface protective layer 603 were continuously deposited on the conductive cylindrical substrate 601 by plasma-assisted CVD. This triple-structure deposited film surface was subjected to polishing in the atmosphere to remove the vertexes of protrusions 604 to flatten the surface, thus a photosensitive member was produced. Thus, as a result of the removing of the vertexes of protrusions 604 by the above polishing, the a-C:H surface protective layer 603 and a-SiC:H intermediate layer 605 which had covered the vertexes came lost there.

First, using the plasma-assisted CVD film formation apparatus constructed as shown in FIG. 11, a triple-structure deposited film was prepared by continuously forming an a-Si:H photoconductive layer, an a-SiC:H intermediate layer and an a-C:H surface protective layer on a cylindrical aluminum substrate of 30 mm in outer diameter. In this deposited film, though the uppermost layer a-C:H surface protective layer also took part, protrusions having occurred during the deposition of the a-Si:H photoconductive layer were seen as shown in FIG. 6A. At the vertexes of such protrusions, like the a-SiC:H intermediate layer, the a-C:H surface protective layer also stood deposited in such a form that it covered the protrusion surfaces.

Conditions used in this Comparative Example when the a-Si:H photoconductive layer, the a-SiC:H intermediate layer and the a-C:H surface protective layer were deposited by plasma-assisted CVD and their deposited-film thickness are the same as those in Example 17.

Next, in respect of this triple-structure deposited film thus formed, having the protrusions having occurred in the a-Si:H photoconductive layer, only the part of protrusions was selectively polished away by surface polishing in the atmosphere by means of the polishing apparatus having the construction diagrammatically shown in FIG. 7, to flatten the surface in such a way that the difference in height arising from the protrusions was brought down to the level as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions. As the result, both the a-SiC:H intermediate layer and the a-C:H surface protective layer remained at the part except the protrusions, but the a-SiC:H intermediate layer and a-C:H surface protective layer which had covered the vertexes of protrusions removed by the surface polishing were polished away and removed like the state shown in FIG. 6B, and the rest of protrusions composed of a-Si:H came uncovered to the surface.

On the electrophotographic photosensitive member thus obtained, too, evaluation was made on the same evaluation items (i.e., adherence of film, melt adhesion of toner, and occurrence of spots), according to the same procedure and under the same evaluation conditions as those in Example 17. Also, on the basis of the results concerning these evaluation items, overall evaluation was made. The results of evaluation are shown in Table 24.

EXAMPLE 18

In this Example, a photosensitive member with the basic construction shown in FIG. 6C was produced, i.e., the one in which the a-Si:H photoconductive layer 602 and the a-SiC:H intermediate layer 605 were deposited on the conductive cylindrical substrate 601 by plasma-assisted CVD and, after this deposited film surface was subjected to polishing in the atmosphere to remove the vertexes of protrusions 604 to flatten the surface, an a-SiC:H surface protective layer 603 was formed thereon.

First, using the plasma-assisted CVD film formation apparatus constructed as shown in FIG. 11, deposited films were prepared by forming an a-Si:H photoconductive layer and an a-SiC:H intermediate layer continuously on a cylindrical aluminum substrate of 108 mm in outer diameter.

Next, this cylindrical substrate with deposited films was taken out of the film formation apparatus. In respect of the deposited films thus formed, having the protrusions as shown in FIG. 6A, only the part of protrusions was selectively polished away by surface polishing in the atmosphere by means of the polishing apparatus having the construction diagrammatically shown in FIG. 7, to flatten the surface as shown in FIG. 6B. Here, polishing conditions were previously so determined by experiment that the part except the protrusions little differed in surface state from that before polishing, as shown by letter symbol A in FIG. 9, and the surface processing was carried out under such polishing conditions.

Next, the cylindrical substrate having the a-Si:H photoconductive layer and the a-SiC:H intermediate layer having been surface-polished was again set in the above plasma-assisted CVD film formation apparatus constructed as shown in FIG. 11, and the a-SiC:H surface protective layer was formed.

Conditions used in this Example when the a-Si:H photoconductive layer, the a-SiC:H intermediate layer and the a-SiC:H surface protective layer were deposited by plasma-assisted CVD and their deposited-film thickness are shown in Table 23.

The cylindrical substrate used in this Example was a cylindrical conductive substrate made of aluminum, having an outer diameter of 108 mm and a wall thickness of 5 mm, the surface of which was mirror-polished and on the surface of which a lower-part blocking layer, the photoconductive layer and the intermediate layer were deposited in order. After the polishing, the surface protective layer (the surface layer) was deposited on its surface to produce an a-Si photosensitive member for positive charging. Also, as high-frequency power for the plasma-assisted CVD film formation apparatus, power with a frequency of 13.56 MHz (RF) was used.

TABLE 23

| Gases and flow rates | Lower-part blocking layer | Photo-conductive layer | Inter-mediate layer | Surface layer |
|---|---|---|---|---|
| $SiH_4$ (mL/min(normal)) | 100 | 200 | 10 | 10 |
| $H_2$ (mL/min(normal)) | 300 | 800 | | |
| $B_2H_6$ (PPM) (based on $SiH_4$) | 2000 | 2 | | |
| NO (mL/min(normal)) | 50 | | | |
| $CH_4$ (mL/min(normal)) | | | 500 | 500 |

charging assembly employing corona discharge and also a cleaner having a cleaning blade. Stated specifically, using GP605 (process speed: 300 mm/sec.), manufactured by CANON INC., as a testing electrophotographic apparatus, 5,000,000-sheet paper feed running was tested using a test pattern having a print area percentage of 1%, which was a print area percentage made lower than usual. During the testing, a whole-area halftone image and a whole-area white image were periodically reproduced to make evaluation on any melt adhesion of toner to the photosensitive member surface and any occurrence of spots. Also, after the 5,000,000-sheet paper feed running was finished, whether or not the blade edge stood damaged was examined to make evaluation. On the basis of the results concerning these evaluation items, overall evaluation was made. The results of evaluation are shown in Table 24.

TABLE 24

| | | Conditions | | | | | Evaluation | | | | | |
|---|---|---|---|---|---|---|---|---|---|---|---|---|
| | | Surface layer | Inter-mediate layer | Polishing | Water washing | Etching | Initial spots | Running spots | Melt adhesion | Blade damage | Adherence | Overall evaluation |
| Ex. 12 | Film formation after polishing | a-C | a-SiC | atmosphere | NO | NO | AA | AA | AA | AA | A | A |
| Ex. 13 | Film formation after polishing | a-C | a-SiC | vacuum | NO | NO | AA | AA | AA | AA | AA | AA |
| Ex. 14 | Film formation after polishing | a-C | a-SiC | atmosphere | YES | NO | AA | AA | AA | AA | AA | AA |
| Ex. 15 | Film formation after polishing | a-C | NONE | atmosphere | NO | NO | AA | AA | AA | AA | A | A |
| Ex. 16 | Film formation after polishing | a-C | NONE | atmosphere | NO | YES | AA | AA | AA | AA | AA | AA |
| Ex. 17 | Film formation after polishing | a-C | a-SiC | atmosphere | NO | NO | AA | AA | AA | — | A | A |
| Ex. 18 | Film formation after polishing | a-SiC | a-SiC | atmosphere | NO | NO | AA | AA | A | AA | A | A |
| Comp. Ex. 4 | Polishing after film formation | a-C | a-SiC | atmosphere | — | — | B | B | A | A | AA | B |
| Comp. Ex. 5 | No polishing | a-C | a-SiC | NO | — | — | A | B | C | C | AA | C |
| Comp. Ex. 6 | Polishing after film formation | a-C | a-SiC | atmosphere | — | — | B | B | B | — | AA | B |

TABLE 23-continued

| Gases and flow rates | Lower-part blocking layer | Photo-conductive layer | Inter-mediate layer | Surface layer |
|---|---|---|---|---|
| Substrate temperature (° C.) | 290 | 290 | 290 | 290 |
| Internal pressure (Pa) | 67 | 67 | 67 | 67 |
| High-frequency power (W) | 500 | 800 | 300 | 300 |
| Layer thickness (μm) | 3 | 30 | 0.5 | 0.5 |

On the electrophotographic photosensitive member produced according to the above procedure, the surface appearance of its deposited-film layer was observed to evaluate the adherence of film. Next, to evaluate its electrophotographic performance, images were formed using the electrophotographic photosensitive member produced in this Example, which was mounted as a light-receiving member to an electrophotographic apparatus provided with a primary What is indicated by letter symbols in Table 24:

AA: Very good.

A: Good.

B: No problem in practical use.

C: A problem in practical use.

-: Not evaluated.

Compare the evaluation results shown together in Table 24. According to the construction of the photosensitive member of the present invention, stated specifically, in the photosensitive members of Examples 12 to 17, in which, in respect of the protrusions having occurred in the a-Si:H photoconductive layer, the surface is once subjected to polishing. In this polishing, only the vertexes of the protrusions are removed to flatten the surface in such a way that the surrounding deposited-film layer except the protrusions is kept substantially not to be polished. Thereafter, the a-C:H surface protective layer is formed at the outermost surface. Thus, the deposited film, in particular, the surface protective layer at the outermost surface has been kept to have good adherence. Also, only the vertexes of protrusions are removed and any mechanical damage caused by the polishing does not occur around them. Thus, the photosensitive member can have superior performance as the light-receiving member. Stated specifically, since there are no hills arising from the protrusions, the melt adhesion can be kept from occurring and also any damage on the blade used in cleaning can also be prevented. In addition, since the photosensitive member has a form in which the a-C:H surface protective layer covers its outermost surface uniformly, any image defects as typified by initial spots (spots appearing at the initial stage) may less occur, and the image defects such as running spots (spots appearing with running) resulting from an increase in any faults of the a-C:H surface protective layer during repeated service can also be well kept from increasing.

When the polishing is carried out in order to remove only the protrusions having occurred in the a-Si:H photoconductive layer, the polishing may be carried out in the atmosphere. Thereafter, before the deposition is again performed to form the a-C:H surface protective layer at the outermost surface, the surface may be subjected to water washing, or to gas-phase etching immediately before the deposition. This can eliminate any influence accompanied by the exposure of surface to the atmosphere, and can attain much superior adherence. Meanwhile, the polishing may also be carried out in vacuum, where the deposition is again performed to form the a-C:H surface protective layer without exposing the surface to the atmosphere. This can attain much superior adherence.

In the photosensitive member of Example 18, in which the a-SiC:H surface protective layer is formed at the outermost surface, it is a little inferior in respect of melt adhesion, to the photosensitive member of Example 12, in which the a-C:H surface protective layer is formed. On other performances, however, the satisfactory results as stated above can be obtained.

As described above, the electrophotographic photosensitive member production process of the present invention is carried out through the steps of:

as a first step, placing a cylindrical substrate having a conductive surface, in a deposition chamber having at least an evacuation means and a material gas feed means and capable of being made vacuum-airtight, and decomposing a material gas containing at least silicon atoms, by means of a high-frequency electric power to deposit on the cylindrical substrate a photoconductive layer formed of at least the non-single-crystal silicon;

as a second step, once taking out of the deposition chamber the substrate on which the photoconductive layer formed of at least the non-single-crystal silicon has been deposited; and as a third step, again placing in the deposition chamber the substrate on which the photoconductive layer formed of at least the non-single-crystal silicon has been deposited, and decomposing a material gas containing at least carbon atoms, by means of a high-frequency electric power to again deposit on the photoconductive layer formed of at least the non-single-crystal silicon a layer formed of a non-single crystal material composed basically of at least carbon atoms. This has made it possible to produce at a low cost the electrophotographic photosensitive member which can maintain formation of good images over a long period of time, preventing faulty images and toner melt adhesion.

It is more advantageous that the substrate on which the deposition or polishing has been completed is further brought into contact with water between the second step and the third step or simultaneously with either step. Stated specifically, the washing with water brings about an improvement in adherence when the surface layer is thereafter formed, and also affords a very broad latitude for any film peeling.

When the film is formed in the third step, it is also preferable to remove the outermost-surface oxide layer or to etch the photosensitive member surface gently, in order to eliminate the unwanted interface as far as possible.

In another electrophotographic photosensitive member provided by the present invention, when, e.g., films are deposited in triple-layer structure consisting of the photoconductive layer a-Si:H, the intermediate layer a-SiC:H and the surface protective layer a-C:H, the protruded portions having their starting points in the photoconductive layer a-Si:H are subjected to surface processing to once remove only the part of protrusions before the surface protective layer a-C:H is formed. The surface processing is carried out under processing conditions that do not cause any damage ascribable to the processing, in the surrounding normal growth regions. Hence, the surface of the electrophotographic photosensitive member obtained can be flat, and does not cause any melt adhesion or any damage of the blade for cleaning. In addition, the electrophotographic apparatus making use of such a photosensitive member has an advantage that the image defects as typified by initial-stage spots can be kept from occurring and also, even after long-term service, the image defects as typified by spots caused by running can be kept from occurring greatly. Also, the surface processing carried out before the surface protective layer a-C:H is deposited can prevent the adherence from lowering not to cause, e.g., the peeling of the outermost-layer surface protective layer a-C:H. Thus the good-quality electrophotographic photosensitive member can be produced.

What is claimed is:

1. A process for producing an electrophotographic photosensitive member comprising the steps of:

as a first step, placing a cylindrical substrate having a conductive surface, in a deposition chamber having at least an evacuation means and a material gas feed means and capable of being made vacuum-airtight, and decomposing a material gas by means of high-frequency electric power to deposit on the cylindrical substrate a first layer, having a photoconductive layer formed of a non-single-crystal material composed basically of silicon atoms, and provided on the photoconductive layer, an intermediate layer formed of a non-single-crystal material composed basically of silicon atoms and containing at least one selected from the group consisting of carbon atoms, oxygen atoms and nitrogen atoms;

as a second step, exposing to atmospheric pressure the cylindrical substrate on which the first layer has been deposited; and as a third step, decomposing a material gas by means of high-frequency electric power in a deposition chamber having at least an evacuation means and a material gas feed means and capable of being made vacuum-airtight to further deposit a second layer formed of at least a non-single-crystal material on the cylindrical substrate to which the treatment of the second step has been applied.

2. The process for producing an electrophotographic photosensitive member according to claim 1, wherein said second step comprises the step of once taking out of the deposition chamber the cylindrical substrate on which said first layer has been deposited.

3. The process for producing an electrophotographic photosensitive member according to claim 1, wherein in said third step said non-single-crystal material is a non-single-crystal material composed basically of carbon atoms.

4. The process for producing an electrophotographic photosensitive member according to claim 3, wherein in said third step the non-single-crystal material further contains silicon atoms.

5. The process for producing an electrophotographic photosensitive member according to claim 4, wherein in said third step said silicon atoms are contained in a ratio of $0.2 \leqq Si/(Si+C) < 10$ atomic % to the sum of the silicon atoms and the carbon atoms.

6. The process for producing an electrophotographic photosensitive member according to claim 4, wherein in said third step said silicon atoms are contained in a ratio of $0.2 \leqq Si/(Si+C) < 5$ atomic % to the sum of the silicon atoms and the carbon atoms.

7. The process for producing an electrophotographic photosensitive member according to claim 1, wherein said third step comprises providing on the substrate side of said second layer a layer formed of a non-single-crystal material composed basically of silicon atoms and containing at least one selected from carbon atoms, oxygen atoms and nitrogen atoms.

8. The process for producing an electrophotographic photosensitive member according to claim 1, wherein the temperature of said cylindrical substrate differs as between said first step and said third step.

9. The process for producing an electrophotographic photosensitive member according to claim 8, wherein in said first step the temperature of said cylindrical substrate is set to be from 200° C. to 450° C.

10. The process for producing an electrophotographic photosensitive member according to claim 8, wherein in said third step the temperature of said cylindrical substrate is set to be from 20° C. to 150° C.

11. The process for producing an electrophotographic photosensitive member according to claim 10, wherein in said third step the temperature of said cylindrical substrate is set to be room temperature.

12. The process for producing an electrophotographic photosensitive member according to claim 1, which has, as part of said second step, the step of leaving for at least 30 minutes the photosensitive member on which said first layer has been deposited.

13. The process for producing an electrophotographic photosensitive member according to claim 1, which has, as part of said second step, the step of performing an inspection of the photosensitive member on which said first layer has been deposited.

14. The process for producing an electrophotographic photosensitive member according to claim 13, wherein said inspection comprises an inspection of external appearance.

15. The process for producing an electrophotographic photosensitive member according to claim 13, which has, in said inspection, the step of bringing the photosensitive member on which said first layer has been deposited, into contact with ozone.

16. The process for producing an electrophotographic photosensitive member according to claim 13, wherein said inspection comprises an image inspection of the photosensitive member on which said first layer has been deposited.

17. The process for producing an electrophotographic photosensitive member according to claim 13, wherein said inspection comprises inspection of electrical characteristics of the photosensitive member on which said first layer has been deposited.

18. The process for producing an electrophotographic photosensitive member according to claim 1, which has, as part of said second step, the step of bringing the photosensitive member on which said first layer has been deposited, into contact with water.

19. The process for producing an electrophotographic photosensitive member according to claim 18, wherein the step of bringing the photosensitive member into contact with water comprises washing.

20. The process for producing an electrophotographic photosensitive member according to claim 1, wherein, in said third step, the outermost surface of the photosensitive member on which said first layer has been deposited is previously subjected to etching, and thereafter the second layer formed of at least a non-single-crystal material is deposited.

21. An electrophotographic photosensitive member produced by the process according to any one of claims 1, 2, 3–6 and 7–20.

22. An electrophotographic apparatus comprising the electrophotographic photosensitive member according to claim 21.

23. An electrophotographic photosensitive member comprising: a cylindrical substrate formed of a conductive material; a photoconductive layer formed of a non-single-crystal material composed basically of silicon atoms, deposited on the cylindrical substrate; an intermediate layer composed basically of silicon atoms and containing at least one selected from the group consisting of carbon atoms, oxygen atoms and nitrogen atoms, deposited on the photoconductive layer; and a surface protective layer formed of a non-single-crystal material, deposited on the immediate layer, said photoconductive layer being a layer formed of a non-single-crystal material which is deposited on said cylindrical substrate by decomposing a material gas containing at least silicon atoms by means of high-frequency electric power in a deposition chamber having at least an evacuation means and a material gas feed means and capable of being made vacuum-airtight, said intermediate layer being a layer formed of a non-single-crystal material which is deposited on said photoconductive layer by decomposing a material gas by means of high-frequency electric power in a deposition chamber having at least an evacuation means and a material gas feed means and capable of being made vacuum-airtight to form a deposited film, said deposited film being thereafter subjected to surface processing to have a processed surface, and said surface protective layer being a layer formed of a non-single-crystal material which is deposited on said intermediate layer having the processed surface, by decomposing a material gas by means of high-frequency electric power in a deposition chamber having at least an evacuation means and a material gas feed means and capable of being made vacuum-airtight.

24. The electrophotographic photosensitive member according to claim 23, wherein said surface processing applied to the intermediate layer is processing which is carried out after the layer formed of a non-single-crystal material has been deposited, in order to remove the vertices of protrusions which had been present at the surface thereof.

25. The electrophotographic photosensitive member according to claim 24, wherein said surface processing applied to the intermediate layer is polishing.

26. The electrophotographic photosensitive member according to claim 23, wherein said intermediate layer has a surface at which, after the layer formed of a non-single-crystal material has been deposited, the protrusions which has been present at the surface thereof have been removed by polishing to flatten the surface.

27. The electrophotographic photosensitive member according to claim 25 or 26, wherein said polishing is carried out after the layer formed of a non-single-crystal material has been deposited, by bringing a polishing tape into contact with the surface of that layer by means of an elastic roller, providing a relative difference in speed between the rotational-movement speed of the deposited-film surface rotationally moved together with said cylindrical substrate and the rotational-movement speed of the elastic roller which brings the polishing tape into contact with that surface.

28. The electrophotographic photosensitive member according to claim 23, wherein said surface processing is carried out in the atmosphere.

29. The electrophotographic photosensitive member according to claim 25, wherein the surface of the layer formed of a non-single-crystal material, used in at least said intermediate layer, has been subjected to washing by bringing that surface into contact with water in the course of the surface processing or after the surface processing.

30. A process for producing an electrophotographic photosensitive member comprising: a cylindrical substrate formed of a conductive material; a photoconductive layer formed of a non-single-crystal material composed basically of silicon atoms, deposited on the cylindrical substrate; an intermediate layer formed of a non-single-crystal material composed of silicon atoms and containing at least one selected from the group consisting of carbon atoms, oxygen atoms and nitrogen atoms, deposited on the photoconductive layer; and a surface protective layer formed of a non-single-crystal material, deposited on the intermediate layer; the process comprising the steps of:

(a) a first step of depositing the photoconductive layer and the intermediate layer on the cylindrical substrate in stated layer thickness by decomposing a material gas containing at least silicon atoms by means of high-frequency electric power in a deposition chamber having at least an evacuation means and a material gas feed means and capable of being made vacuum-airtight;

(b) a second step of subjecting the intermediate layer formed in the first step to surface processing; and (c) a third step of depositing the surface protective layer in a stated layer thickness on the surface of the intermediate layer which has been subjected to surface processing in the second step, by decomposing a material gas by means of high-frequency electric power in a deposition chamber having at least an evacuation means and a material gas feed means and capable of being made vacuum-airtight.

31. The process for producing an electrophotographic photosensitive member according to claim 30, wherein in said second step the surface processing applied to the deposited film formed in said first step is processing which is carried out in order to remove at least the vertices of protrusions present at the surface of the deposited film formed in said first step.

32. The process for producing an electrophotographic photosensitive member according to claim 31, wherein in said second step the surface processing applied to the deposited film formed in said first step is polishing.

33. The process for producing an electrophotographic photosensitive member according to claim 32, wherein said polishing is to polish away the protrusions present at the surface of the deposited film formed in said first step, to flatten that surface.

34. The process for producing an electrophotographic photosensitive member according to claim 32 or 33, wherein said polishing is carried out by bringing a polishing tape into contact with the surface of the deposited film formed in said first step, by means of an elastic roller, providing a relative difference in speed between the rotational-movement speed of the deposited-film surface rotationally moved together with the cylindrical substrate and the rotational-movement speed of the elastic roller which brings the polishing tape into contact with that surface.

35. The process for producing an electrophotographic photosensitive member according to claim 30, wherein in said second step the surface processing is carried out in the atmosphere.

36. The process for producing an electrophotographic photosensitive member according to claim 30, wherein in said second step the surface being processed is brought into contact with water simultaneously with the surface processing, or, after said second step and before said third step, the surface having been processed is brought into contact with water to make washing treatment.

37. An electrophotographic apparatus comprising a photosensitive member comprising: a cylindrical substrate; a photoconductive layer formed of a non-single-crystal material composed basically of silicon atoms, deposited on the cylindrical substrate; an intermediate layer formed of a non-single-crystal material and containing at least one selected from the group consisting of carbon atoms, oxygen atoms and nitrogen atoms, deposited on the photoconductive layer; and a surface protective layer formed of a non-single-crystal material, deposited on the intermediate layer;

in said photosensitive member, said cylindrical substrate being a cylindrical substrate formed of a conductive material, said photoconductive layer being a layer formed of a non-single-crystal material which is deposited on the cylindrical substrate by decomposing a material gas containing at least silicon atoms by means of high-frequency electric power in a deposition chamber having at least an evacuation means and a material gas feed means and capable of being made vacuum-airtight, said intermediate layer being a layer formed of a non-single-crystal material which is deposited on the photoconductive layer by decomposing a material gas by means of high-frequency electric power in a deposition chamber having at least an evacuation means and a material gas feed means and capable of being made vacuum-airtight, to form a deposited film, said deposited film being thereafter subjected to surface processing to have a surface from which vertices of protrusions which had been present at the surface have been removed, and said surface protective layer being a layer formed of a non-single-crystal material which is deposited on the intermediate layer having the processed surface, by decomposing a material gas by means of high-frequency electric power in a deposition chamber having at least an evacuation means and a material gas feed means and capable of being made vacuum-airtight.

38. The electrophotographic apparatus according to claim 37, wherein said surface processing applied to the intermediate layer constituting said photosensitive member is polishing.

39. The electrophotographic photosensitive member according to claim 38, wherein said surface processing applied to the intermediate layer constituting said photosensitive member is carried out after the layer formed of a non-single-crystal material has been deposited, by bringing a polishing tape into contact with the surface of that layer by means of an elastic roller, providing a relative difference in speed between the rotational-movement speed of the deposited-film surface rotationally moved together with said cylindrical substrate and the rotational-movement speed of the elastic roller which brings the polishing tape into contact with that surface.

40. The electrophotographic apparatus according to claim 38, wherein said polishing applied to the surface of the intermediate layer constituting said photosensitive member is carried out in the atmosphere.

41. The electrophotographic apparatus according to claim 38, wherein the surface of the intermediate layer has been subjected to washing by bringing that surface into contact with water in the course of the polishing of the surface or after the polishing.

42. The electrophotographic photosensitive member according to claim 23, wherein said surface protective layer is a layer formed of a non-single-crystal material composed basically of at least carbon atoms, deposited using a material gas containing at least carbon atoms.

43. The process for producing an electrophotographic photosensitive member according to claim 30, wherein said third step is the step of depositing a layer formed of a non-single-crystal material composed basically of at least carbon atoms, using a material gas containing at least carbon atoms.

44. The electrophotographic apparatus according to claim 37, wherein said surface protective layer of said photosensitive member is a layer formed of a non-single-crystal material composed basically of at least carbon atoms, deposited using a material gas containing at least carbon atoms.

* * * * *

UNITED STATES PATENT AND TRADEMARK OFFICE

CERTIFICATE OF CORRECTION

PATENT NO. : 6,846,600 B2
DATED : January 25, 2005
INVENTOR(S) : Toshiyuki Ehara et al.

It is certified that error appears in the above-identified patent and that said Letters Patent is hereby corrected as shown below:

Title page,
Item [30], Foreign Application Priority Data,
"2001/023703 should read -- 2001-023703
2001/038477 2001-038477
2001/059693 2001-059693
2002/020492" 2002-020492 --.
Item [57], ABSTRACT,
Line 3, "single crystal" should read -- single-crystal --.
Line 11, "non-single crystal" should read -- non-single-crystal --.

Column 2,
Line 13, "to the" should read -- to adhere to the --.

Column 3,
Lines 19 and 21, "defectives" should read -- defects --.

Column 8,
Line 13, "defectives" should read -- defects --.

Column 10,
Line 66, "materials" should read -- material --.

Column 11,
Line 34, "carries" should read -- carriers --.
Line 62, "$ASH_3$," should read -- $AsH_3$, --.

Column 14,
Line 58, "preferably at" should read -- preferably be at --.

Column 16,
Lines 40 and 46, "materials" should read -- material --.

Column 18,
Line 1, "extendingly" should read -- extendedly --.
Line 34, "though" should read -- through --.

Column 19,
Lines 17 and 23, "materials" should read -- material --.

UNITED STATES PATENT AND TRADEMARK OFFICE

CERTIFICATE OF CORRECTION

PATENT NO. : 6,846,600 B2
DATED : January 25, 2005
INVENTOR(S) : Toshiyuki Ehara et al.

It is certified that error appears in the above-identified patent and that said Letters Patent is hereby corrected as shown below:

Column 20,
Line 19, “materials” should read -- material --.

Column 22,
Line 16, “constituents” should read -- constituent --.

Column 26,
Line 42, “It” should read -- it --.
Line 53, “excess.” should read -- excessive. --.

Column 28,
Line 15, “members” should read -- member --.

Column 53,
Line 54, “non-single crystal” should read -- non-single-crystal --.

Column 56,
Line 10, “claims 1, 2,” should read -- claims 1 to 20. --.
Line 11, “3-6 and 7-20.” should be deleted.
Line 62, “has” should read -- had --.

Signed and Sealed this

Fifteenth Day of November, 2005

JON W. DUDAS
*Director of the United States Patent and Trademark Office*